US010441041B2

(12) United States Patent
Haller et al.

(10) Patent No.: US 10,441,041 B2
(45) Date of Patent: Oct. 15, 2019

(54) UMBRELLA FRAME

(71) Applicant: John L. Haller, La Jolla, CA (US)

(72) Inventors: John L. Haller, La Jolla, CA (US); Darwin G. Vasquez, South El Monte, CA (US)

(73) Assignee: John L. Haller, La Jolla, CA (US)

( * ) Notice: Subject to any disclaimer, the term of this patent is extended or adjusted under 35 U.S.C. 154(b) by 0 days.

(21) Appl. No.: 16/129,583

(22) Filed: Sep. 12, 2018

(65) Prior Publication Data

US 2019/0008245 A1 Jan. 10, 2019

Related U.S. Application Data

(63) Continuation of application No. 15/473,156, filed on Mar. 29, 2017, now Pat. No. 10,098,425, which is a continuation-in-part of application No. 14/547,577, filed on Nov. 19, 2014, now Pat. No. 9,642,422.

(51) Int. Cl.

| | |
|---|---|
| ***A45B 25/02*** | (2006.01) |
| ***A45B 23/00*** | (2006.01) |
| ***A45B 19/10*** | (2006.01) |
| ***A45B 25/14*** | (2006.01) |

(52) U.S. Cl.

CPC ..... *A45B 25/02* (2013.01); *A45B 19/10* (2013.01); *A45B 23/00* (2013.01); *A45B 25/14* (2013.01); *A45B 2023/0006* (2013.01)

(58) Field of Classification Search

CPC ..... A45B 25/02
USPC ..... 135/15.1, 31, 19.5
See application file for complete search history.

(56) References Cited

U.S. PATENT DOCUMENTS

| | | | |
|---|---|---|---|
| 19,998 | A | 4/1858 | Kurth |
| 145,733 | A | 12/1873 | Griswold |
| 1,290,245 | A | 1/1919 | Kuehner |
| 1,316,421 | A | 9/1919 | Cannon, Jr. |
| 1,749,363 | A | 3/1930 | Venner, Jr. |
| 2,024,946 | A | 12/1935 | Morgenstern |
| 2,474,516 | A | 6/1949 | Daniel |
| 2,492,376 | A | 12/1949 | Brillas |

(Continued)

FOREIGN PATENT DOCUMENTS

| | | | |
|---|---|---|---|
| GB | 655269 | A | 7/1951 |

OTHER PUBLICATIONS

Shade for Plants, Photo of Shade Dot (Shade for Plants), by Little Gree Company/Shadeforplants.com, Dave's Garden, Feb. 20, 2015, Internet Brands, pp. 1-2.

(Continued)

*Primary Examiner* — Noah Chandler Hawk
(74) *Attorney, Agent, or Firm* — Gordon Reed Scully Mansukhani LLP; David R. Heckadon

(57) ABSTRACT

An umbrella assembly is provided that includes a frame, a canopy, an extension and a base. The frame includes a post and top piece, a number of arms, a number of connectors, a lift ring and a locking pin. The post includes a number of rod members attached together in adjacent parallel space orientation with a top piece which rotatably attaches to each of a number of arms each arm having a number of arm rod members attached together in adjacent parallel space orientation. Each arm is rotatably attached to one end of a connector. The other end of each connector is rotatably attached to the lift ring. Raising and lowering the lift ring opens and closes the umbrella arms. The locking pin holds the lift ring in an upper position.

19 Claims, 42 Drawing Sheets

(56) References Cited

U.S. PATENT DOCUMENTS

| | | | |
|---|---|---|---|
| 2,517,827 | A | 8/1950 | Balsam |
| 2,561,435 | A | 7/1951 | Woodward |
| 2,640,490 | A | 6/1953 | Kramer |
| 3,021,985 | A | 2/1962 | Sarver |
| 3,467,114 | A | 9/1969 | McSherry |
| 4,361,982 | A | 12/1982 | Horowitz |
| 4,597,221 | A | 7/1986 | Adair et al. |
| 4,942,693 | A | 7/1990 | Sibold |
| 5,135,016 | A | 8/1992 | Stiller |
| 5,158,102 | A | 10/1992 | Lemcke |
| 6,314,976 | B1 | 11/2001 | Clarke |
| 6,862,843 | B2 | 3/2005 | Missry |
| D513,117 | S | 12/2005 | Raede |
| 9,138,035 | B2 | 9/2015 | Stochetti |
| 2006/0207639 | A1 | 9/2006 | Ko |
| 2007/0089769 | A1 | 4/2007 | Li |
| 2008/0092440 | A1 | 4/2008 | Johnson |
| 2010/0107488 | A1 | 5/2010 | King et al. |
| 2013/0048038 | A1 | 2/2013 | Herrera |

OTHER PUBLICATIONS

Seed Umbrellas, Foobear, Instructables, Feb. 20, 2015, pp. 1-9.
An Image of a Potted Plant Shaded by Umbrellas, Takai, 123rf.com, Feb. 20, 2015, pp. 1-3.
Plant Supports and Stakes, Pinterest, Feb. 20, 2015, pp. 1-2.
Garden, Pinterest, de Graaf, Feb. 20, 2015, pp. 1-4.
Umbrella for Plants, Umbrella for Plants Suppliers and Manufacturers, Alibaba.com, Feb. 20, 2015, pp. 1-7.

FIG.11H(ii)

UMBRELLA FRAME

CROSS-REFERENCE TO RELATED APPLICATIONS

This application is a Continuation of and claims the benefit of U.S. patent application Ser. No. 15/473,156 filed Mar. 29, 2017, which is a Continuation-In-Part of U.S. patent application Ser. No. 14/547,577 filed Nov. 19, 2014, now U.S. Pat. No. 9,642,422 issued May 9, 2017, the full disclosures of which are incorporated herein by reference in their entirety for all purposes.

BACKGROUND

Technical Field

This invention relates to an umbrella and an umbrella frame. More particularly, the present application involves an umbrella frame including a post, arms, connectors, and a lift ring wherein the post or arms may be multiple spaced rod elements.

Umbrellas are widely used for personal and garden protection. There are a variety of umbrellas that are available in the market place which are used to protect a user from rain, sun, wind, and sometimes snow. An umbrella is basically made up of a frame and a fabric cover fixed to the top of the frame. The basic umbrella frame includes a post or shaft, a plurality of arms or spokes or ribs that are generally connected to the top of the post. The frame also includes a moveable element or lift ring which moves up and down the post to facilitate opening or spreading the arms and closing or retracting the arms, often referred to as opening and closing the umbrella. The lift ring is coupled to each arm by separate modular connectors or connectors.

The connection between the top of the post and each arm is rotatable. The connection between each arm and the connector is rotatable. The connection between each connector and the lift ring is rotatable. These rotatable connections facilitate relative movement of the respective members.

In the umbrella market, umbrellas are categorized on their size, durability, maintainability and mechanical strength. These parameters determine a given umbrella's suitability for use in a particular environment, for a particular purpose for a particular user.

It is not uncommon for an umbrella to collapse or break due to long use or because of extreme and challenging environmental conditions. For example, umbrellas can be damaged by sever and unexpected weather or strong winds, which can cause the component parts or members of the umbrella frame to break, crack or bend rendering the umbrella unsuitable. Umbrellas are also damaged as a result of improper or reckless handling while assembling, transporting, maintaining, or operating. Many of the umbrellas known in the art suffer the disadvantage of not being sufficiently strong to withstand strong winds or other harsh weather environmental conditions or mishandling. Many umbrellas in the art are so frail and mechanically weak that once they suffer damage they cannot be repaired. These problems with umbrellas in the art result from structural designs that do not provide the mechanical strength for proper and prolonged use and operation.

The mechanical strength of the umbrella frame is of significant importance to the user in that umbrellas by their nature are used in circumstances of prolonged exposure to the sun's rays and of inclement weather, rain and wind. The umbrella structure of this invention provides enhanced strength making the umbrella more stable and therefore provides better service and longer operational life. There have been a number of attempts to increase the strength of an umbrella by heavier materials, and reinforcement accessories for the arms and connectors but these attempts merely make the umbrella heavier, more bulky and less user-friendly.

Thus there exist a need for an umbrella frame that provides greater strength and a more stable mechanical assembly which can provide the user increased value and satisfaction with greater efficiency and a longer life.

SUMMARY

An object of the present invention is to provide an umbrella fame including a post having a top end and a bottom end, a plurality of arms each rotatably connected to the post proximate the top end, a lift ring mounted circumferentially around the post moveable up and down the post and a plurality of connectors each rotatably attached at one end to an intermediate and fixed location to a respective arm and at the other end rotatably attached to the lift ring. The post includes one or more post rods with the plurality of post rods bound to each other with a plurality of post spacers, and/or each arm includes one or more second wires with the plurality of second wires bound to each other with a plurality of arm spacers and/or each connector includes one or more third wires with the plurality of third wires are bound by a plurality of third spacers. The plurality of rods is adjacent and parallel to one another.

Another object of the present invention is to provide any wire member may be substituted by a rod member including but not limited to round, oval, square, triangular, multi-sided wire or wood doweling or metal tubing or solid or tubular plastic.

Another object of the present invention is to provide an umbrella frame having post first spacers, arm second spacers and third connector spacers that are located inside, outside or in-between the plurality of post first rods, plurality of second rods or plurality of third rods respectively. The spacers located along the length of the post, arm or connector member.

Another object of the present invention is to provide an umbrella frame having the plurality of post rods and/or the plurality of arm rods and/or the plurality of connector rods longitudinally bound to each other without the use of post spacers along at least part of the length of the post, the arms or the connectors, respectively. Further the spacers may be a set of spacer members aligned or offset, where the spacer members between two rods may be offset from the spacers between other rods.

Another object of the present invention is to provide an umbrella frame having plurality of post spacers, arm spacers and/or connector spacer that are ball bearings or cylindrical blocks of circular, rectangular or multi-sided cross section that bind all rods or some subset of the rods.

Another object of the present invention is to provide an umbrella frame having two second wires for the arm where the second wires are oriented in a vertical or a horizontal or other oriented plane.

Another object of the present invention is to provide an umbrella frame where the lift ring includes a circular ring with or without an inward or outward protrusion for connection to each connector for each arm.

Another object of the present invention is to provide an umbrella frame where the lift ring includes a plurality of circular rings that are oriented perpendicular to the post which rings are connected by plurality of spacer fixedly connected perpendicularly to the outside of the ring, and the lift ring moves freely alone the post to open and close the umbrella.

Another object of the present invention is to provide an umbrella frame that includes a lock such that the post and lift ring can be secured in the open position with the arms held in a spread position.

Another object of the present invention is to provide an umbrella with an umbrella frame and an umbrella canopy which canopy is a fabric cover that is affixed to the outer ends of the plurality of arms.

Another object of the present invention is to provide an umbrella frame with a lock that includes a pin flexibly connected to the lift ring.

Another object of the present invention is to provide an umbrella frame with a lock that includes a hook member mounted to the upper portion of the post that hooks to and holds the lift ring.

Another object of the present invention is to provide an umbrella that is simple to manufacture, can be easily assembled, has good mechanical strength, is compact, and is light weight and has long life.

Another object of the present invention is to provide an umbrella that is small and suitable for indoor plants is medium and suitable for outdoor plants is large and suitable for personal use, or is conventional size for garden and patio use.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications

BRIEF DESCRIPTION OF THE DRAWINGS

For a better understanding of the present invention and to show more clearly how it may be carried into effect, reference will now be made, by way of example, to the accompanying drawings which show, by way of example, the present invention and in which:

FIG. 14C(i) illustrates the arrangement of one or more rods on a disk connectors according to an embodiment herein;

DETAILED DESCRIPTION OF PREFERRED EMBODIMENTS

Figure 1:
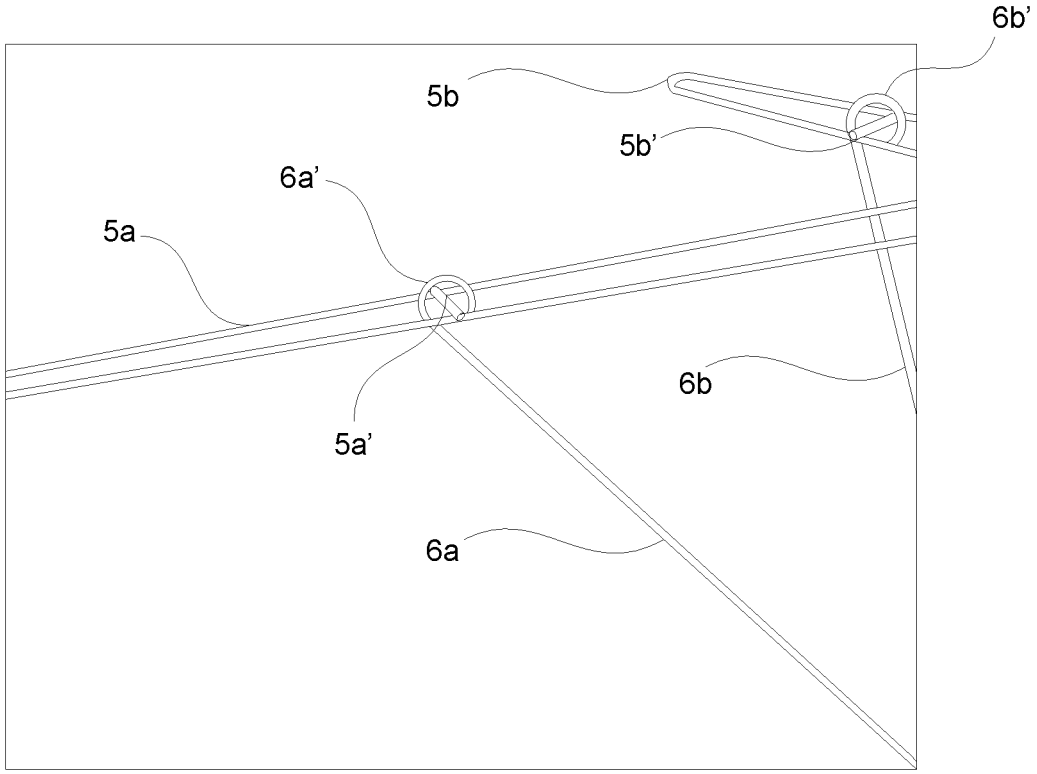
FIG. 1 is a fragmentary side view of a two arms and spacers attached thereon.

The following description and drawings are illustrative and are not to be construed as limiting. Numerous specific details are described to provide a thorough understanding. However, in certain instances, well known or conventional details are not described in order to avoid obscuring the description. References to one or another embodiment in the present disclosure are not necessarily references to the same embodiment.

Reference in this specification to "one embodiment" or "an embodiment" or the like means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described that may be exhibited by some embodiments and not by others. Similarly, various requirements are described that may be requirements for some embodiments but not other embodiments.

The present invention is directed to an umbrella, and more particularly to an umbrella frame and an umbrella assembly which assembles an umbrella frame, a canopy, an extension and an umbrella base. While this invention is suitable for embodiments in many different forms, there is shown in the drawings and will herein be described in detail at least one specific embodiment, with the understanding that the present disclosure is to be considered as an exemplification of the principles of the invention and is not intended to limit the invention to the embodiment or embodiments illustrated. The focus of the present invention is the multi-rod configuration of post, arms, and connector.

With reference to FIGS. 1-18, an umbrella frame is illustrated. As shown in FIG. 2A the umbrella frame 10 includes a post 20 having a top end 20*a* and a bottom end 20*b*. As illustrated the post 20 is made up of four rods or wires 2*a*, 2*b*, 2*c* and 2*d*. The post rods 2*a* and 2*b* are shown as a single half-bent wire 2*ab* whereas the rods 2*c* and 2*d* are made up of another half-bent wire 2*cd*. In one embodiment, the four wires 2*a*, 2*b*, 2*c* and 2*d* may be four separate rods 2*a*, 2*b*, 2*c* and 2*d*.

In an embodiment of the invention the four wires 2*a*, 2*b*, 2*c* and 2*d* can be separate independent rods.

In another embodiment of the invention, the post 20 can be made up of 2, 3, 4, 5, 6 or more wires.

In another embodiment, the post wires and/or arm wires and/or connector wires may be any rod structure including but not limited to round, oval, rectangular, triangular, any solid or tubular metal, wooden dowels, or plastic rod or tube.

In yet another embodiment of the invention, the post 20 and/or arms and/or connectors can be a tubular or a solid member.

The figures show the post rods 2*a*, 2*b*, 2*c* and 2*d* are adjacent and parallel and bound to each other by a spacer such as a set of four post spacer members 3*a*, 3*b*, 3*c* and 3*d* located near the top end 20*a* of the post 20. The post spacers 3*a*, 3*b*, 3*c* and 3*d* provide strength and alignment to the post rods 2*a*, 2*b*, 2*c* and 2*d*.

Figure 14A:
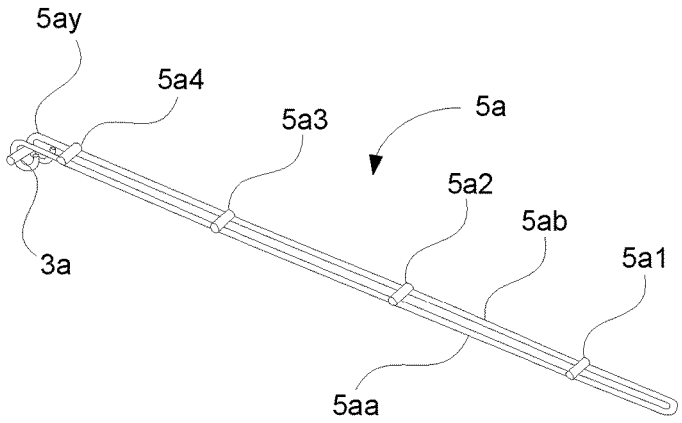
FIG. 14A illustrates four spacers distributed evenly along an arm.
Figure 14B:
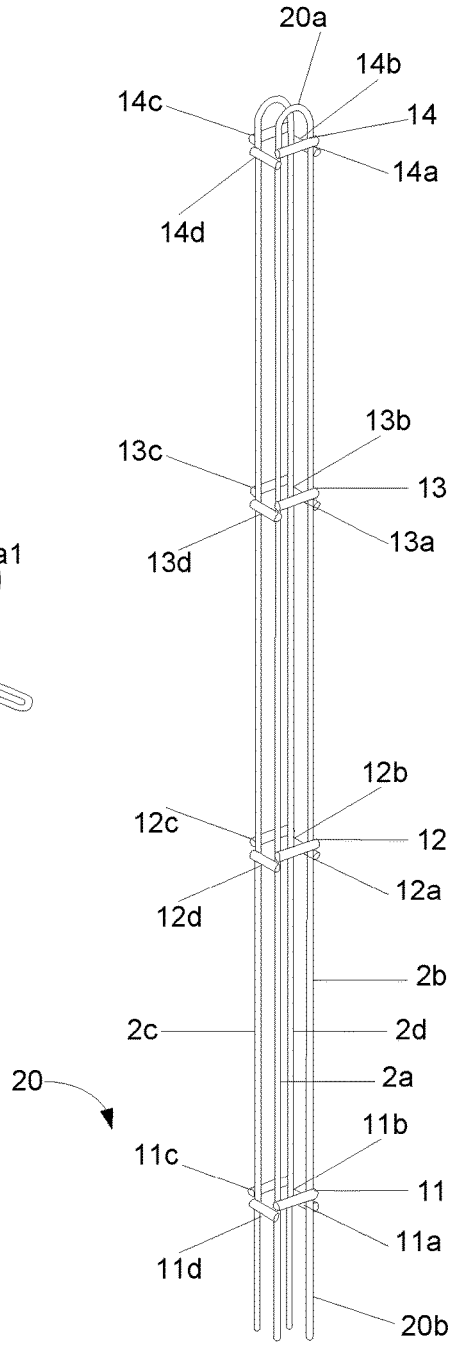
FIG. 14B illustrates four sets of spacers distributed evenly along the post with a "U" bend for the outer end spacer.
Figure 16:
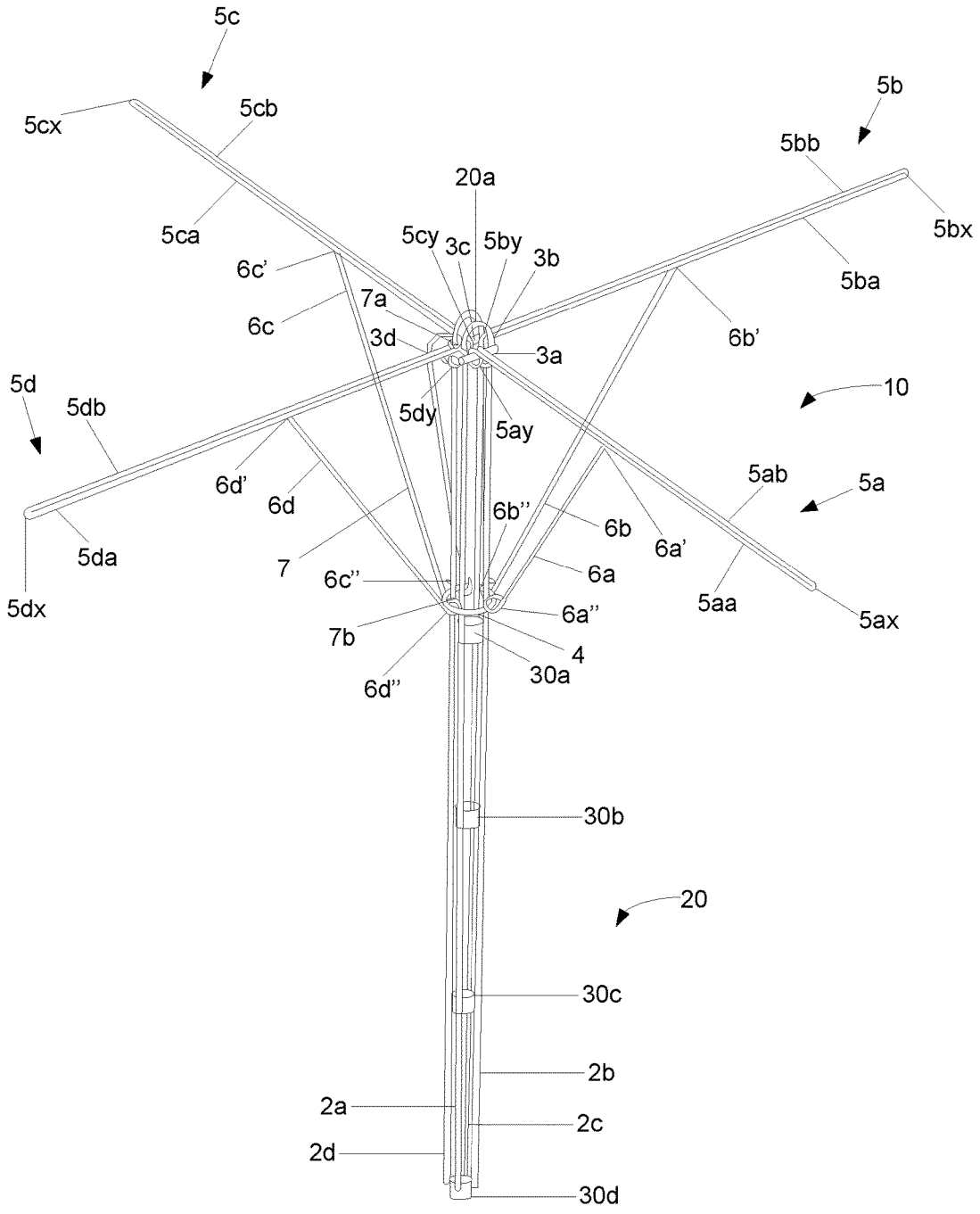
FIG. 16 shows an alternative embodiment of the umbrella frame with cylindrical blocks or plugs spacers mounted along the post.

As shown in FIGS. 14B and 16, and in yet another embodiment of the invention, a plurality of spacer are used to bind the post rods 2*a*, 2*b*, 2*c* and 2*d*. The spacers are provided at locations along the post rods 2*a*, 2*b*, 2*c* and 2*d* for the reason that the combination provides increased resistance against bending the post 20 and improve overall strength of the post 20.

Figure 10A:
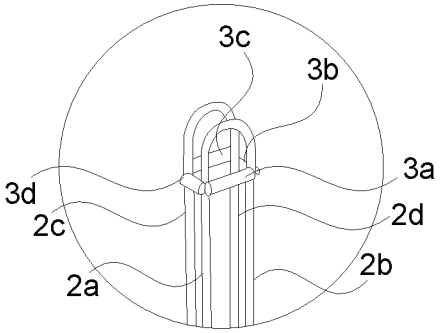
FIG. 10A-10Q shows various alternatives for the post and the arrangement of the spacers near its top end.
Figure 10B:
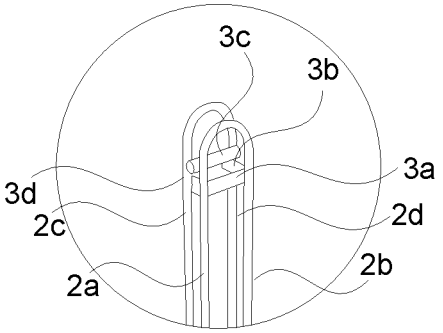
Figure 10C:
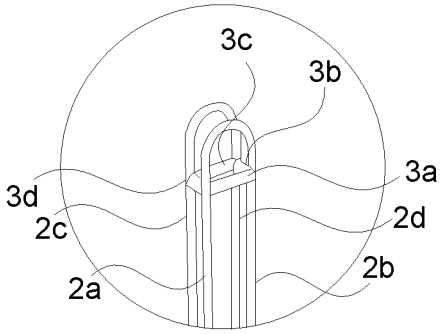
Figure 10D:
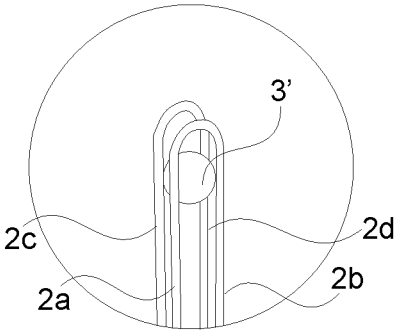
Figure 10E:
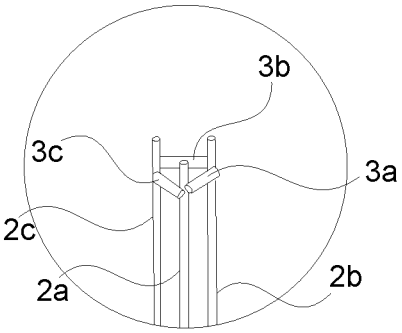
Figure 10F:
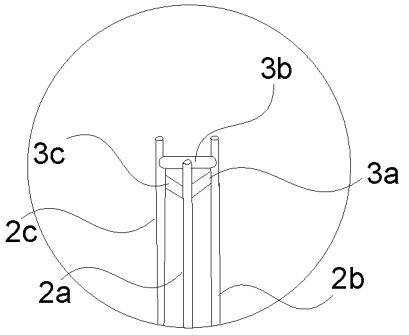
Figure 10G:
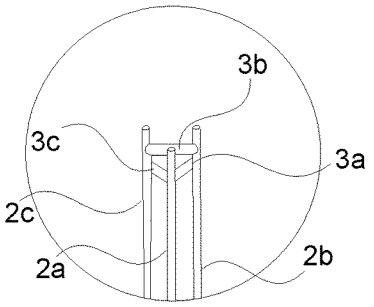
Figure 10H:
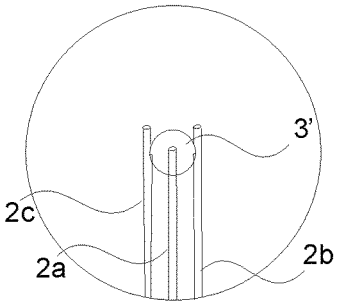
Figure 10I:
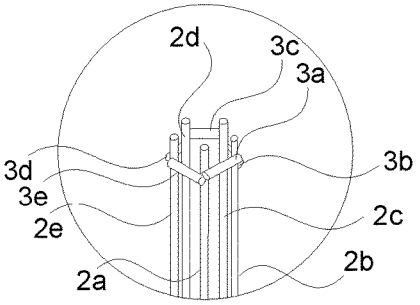
Figure 10J:
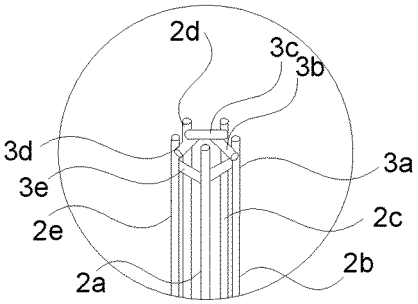
Figure 10K:
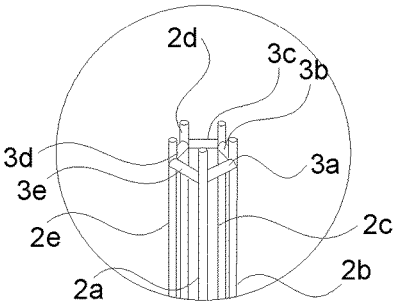
Figure 10L:
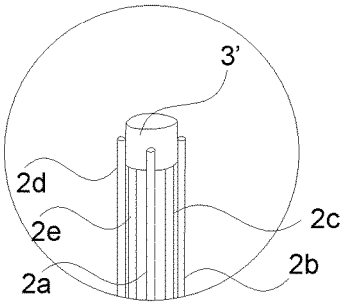
Figure 10M:
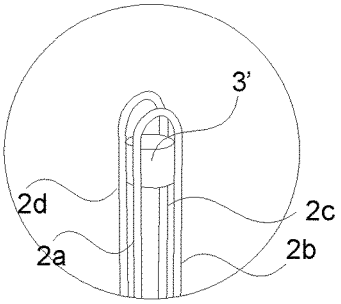
Figure 10N:
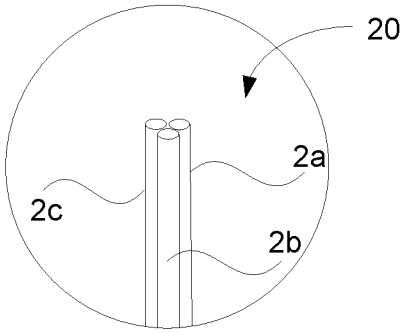
Figure 10O:
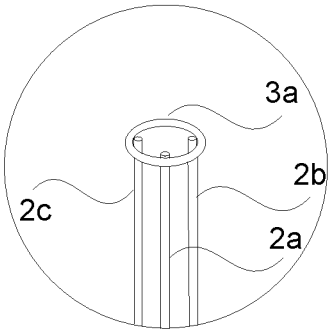
Figure 10P:
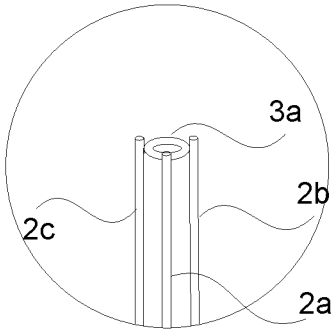
Figure 10Q:
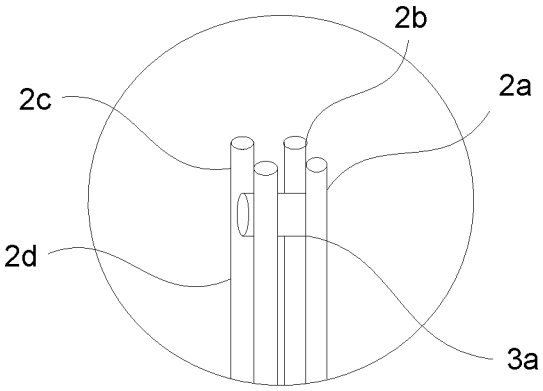

As shown in FIGS. 10A to 10Q, there are different configurations possible for the post spacers 3*a*, 3*b*, 3*c* and 3*d* located along the post 20 (not shown) that bind the post rods 2*a*, 2*b*, 2*c* and 2*d*. The post spacer members 3*a*, 3*b*, 3*c* and 3*d* can be located inside, outside and/or in-between the post rods 2*a*, 2*b*, 2*c* and 2*d*.

FIGS. 10A-10D, 10M and 10O show spacers with reference to a 4 wire post. FIGS. 10E-10H and 10P show spacers with reference to a 3 wire post. FIG. 10I-10L show spacers with reference to a five wire post. FIG. 10N show a spacer with the post wire being bent to be adjacent.

In yet another embodiment of the invention, the post spacer members 3*a*, 3*b*, 3*c* and 3*d* as shown in FIG. 2A may be welded to the post rods 2*a*, 2*b*, 2*c* and 2*d* or affixed by any other mechanism such as an adhesives.

The umbrella frame 10 further includes a movable lift ring 4 mounted circumferentially around the post 20. Four arms 5*a*, 5*b*, 5*c* and 5*d* are coupled to the post 20 proximally at its top end 20*a*. The arm 5*a* is made up of two wires 5*aa* and 5*ab* with the wires 5*aa* and 5*ab* formed of a single half-bent wire where outer end of the arm 5*ab* is an integral "U" bent spacer. Similarly the arms 5*b*, 5*c* and 5*d* includes two wires 5*ba*, 5*bb*; 5*ca*, 5*cb*; 5*da*, 5*db* each as shown in FIG. 2A. Such arm wire may be separate wires or separate rods.

In another embodiment, the post wires and/or arm wires and/or connector wires may be any rod structure including but not limited to round, oval, rectangular, triangular, any solid or tubular metal, wooden dowels, or plastic rod or tube.

The figures show the post rods 2*a*, 2*b*, 2*c* and 2*d* are adjacent and parallel and bound to each other by a spacer such as a set of four post spacer members 3*a*, 3*b*, 3*c* and 3*d* located near the top end 20*a* of the post 20. The post spacers 3*a*, 3*b*, 3*c* and 3*d* provide strength and alignment to the post rods 2*a*, 2*b*, 2*c* and 2*d*.

In yet another embodiment of the invention, the arms 5*a*, 5*b*, 5*c* and 5*d* can be made up of three or more wires.

Figure 15A:
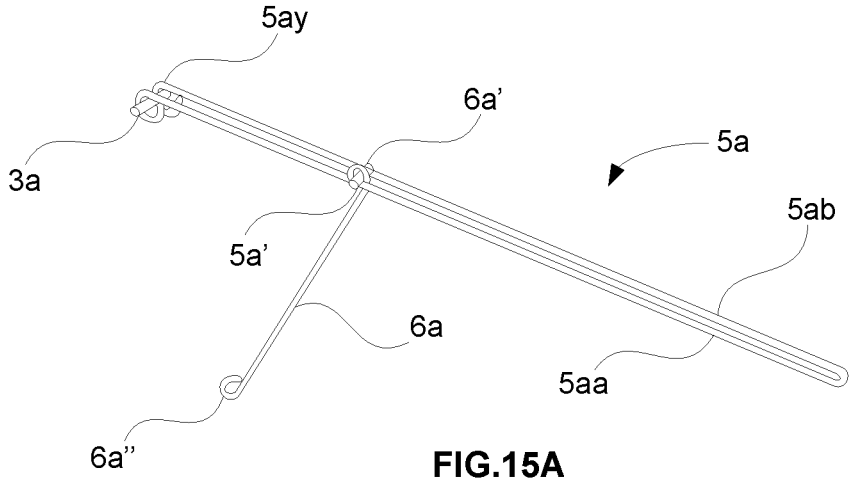
FIG. 15A-15D shows alternative structures connecting the connector and the arm.
Figure 15B:
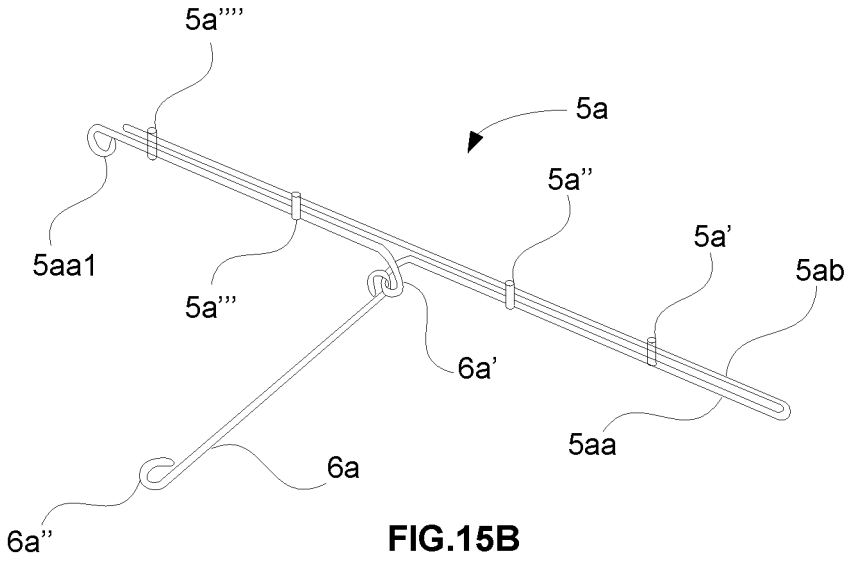
Figure 15C:
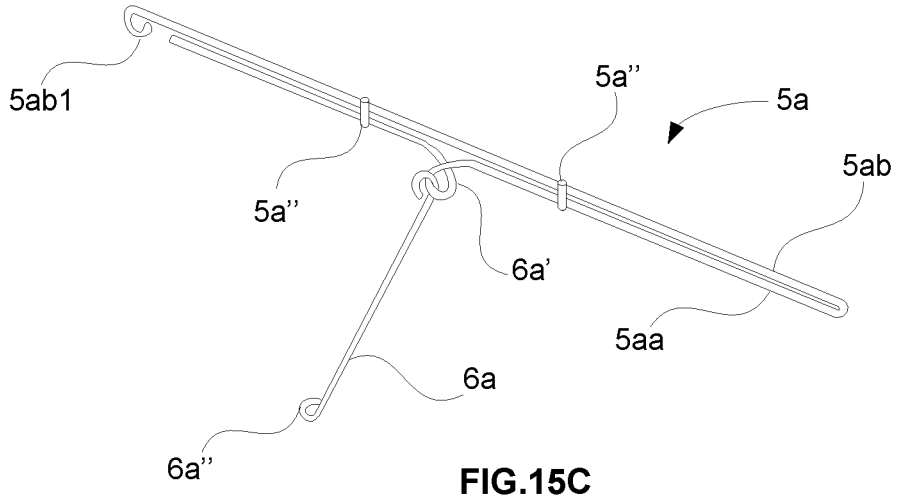

In yet another embodiment of the invention, the plurality of rods of each arm 5*a*, 5*b*, 5*c* and 5*d* may be as shown in FIG. 15B and FIG. 15C with a single wire loop 5*aa*1 and 5*ab*1 towards the inside end of the arm to be connected to the post 20.

The outer end 5*ax*, 5*bx*, 5*cx* and 5*dx* of each of the arms 5*a*, 5*b*, 5*c* and 5*d* is curved due to the half-bent wire configuration of the arms 5*a*, 5*b*, 5*c* and 5*d* while the inner ends 5*ay*, 5*by*, 5*cy* and 5*dy* includes a pair of loops in the form of a hook to connect with the post spacer 3*a*. Similarly the ends 5*by*, 5*cy* and 5*dy* includes wires 5*ba*, 5*bb*; 5*ca*, 5*cb*; 5*da*, 5*db* being bent in hook shape and connected to the post spacers 3*b*, 3*c* and 3*d* respectively.

This hook type attachment of the ends 5*ay*, 5*by*, 5*cy* and 5*dy* permits free rotation of the arms 5*a*, 5*b*, 5*c* and 5*d*.

In yet another embodiment of the invention, the ends 5*ay*, 5*by*, 5*cy* and 5*dy* of the arms 5*a*, 5*b*, 5*c* and 5*d* to be connected to the post spacers 3*a*, 3*b*, 3*c* and 3*d* can be a single closed loop.

Four arm spacers 5*a*', 5*b*', 5*c*' and 5*d*' are mounted intermediately on the arms 5*a*, 5*b*, 5*c* and 5*d*. The arm spacers 5*a*', 5*b*', 5*c*' and 5*d*' provide mechanical strength and rigidity to the arms 5*a*, 5*b*, 5*c* and 5*d* of the umbrella frame 10. The umbrella frame 10 also includes four connectors 6*a*, 6*b*, 6*c* and 6*d*. Each of connector 6*a*, 6*b*, 6*c* and 6*d* has a first end 6*a*', 6*b*', 6*c*' and 6*d*' and a second end 6*a*", 6*b*", 6*c*" and 6*d*". The connector 6*a* has its first end 6*a*' connected to the arm spacer 5*a*' and its second end 6*a*" connected to the lift ring 4. Similarly the connectors 6*b*, 6*c* and 6*d* have their first ends 6*b*', 6*c*' and 6*d*' connected to the arm spacers 5*b*', 5*c*' and 5*d*' and second end 6*b*", 6*c*" and 6*d*" connected to the lift ring 4 as depicted in FIG. 2A. The movable lift ring 4 facilitates the opening and closing of the arms 5*a*, 5*b*, 5*c* and 5*d* by moving freely up and down the post 20. The plurality of post wires and the plurality of post spacers define an empty space between the plurality of post wires.

In yet another embodiment of the invention, the first ends 6*a*', 6*b*', 6*c*' and 6*d*' and the second ends 6*a*", 6*b*", 6*c*" and 6*d*" of the connectors 6*a*, 6*b*, 6*c* and 6*d* are in the form of a closed hook for easy connection to the lift ring 4 and the arm spacers 5*a*', 5*b*', 5*c*' and 5*d*'.

In yet another embodiment of the invention, the first ends 6*a*', 6*b*', 6*c*' and 6*d*' of the connectors 6*a*, 6*b*, 6*c* and 6*d* can be connected directly to the wires 5*aa*, 5*ab*; 5*ba*, 5*bb*; 5*ca*, 5*cb*; 5*da* and 5*db* of the arms 5*a*, 5*b*, 5*c* and 5*d* respectively connected to spacer members 3*a*, 3*b*, 3*c*, and 3*d*.

Figure 2A:
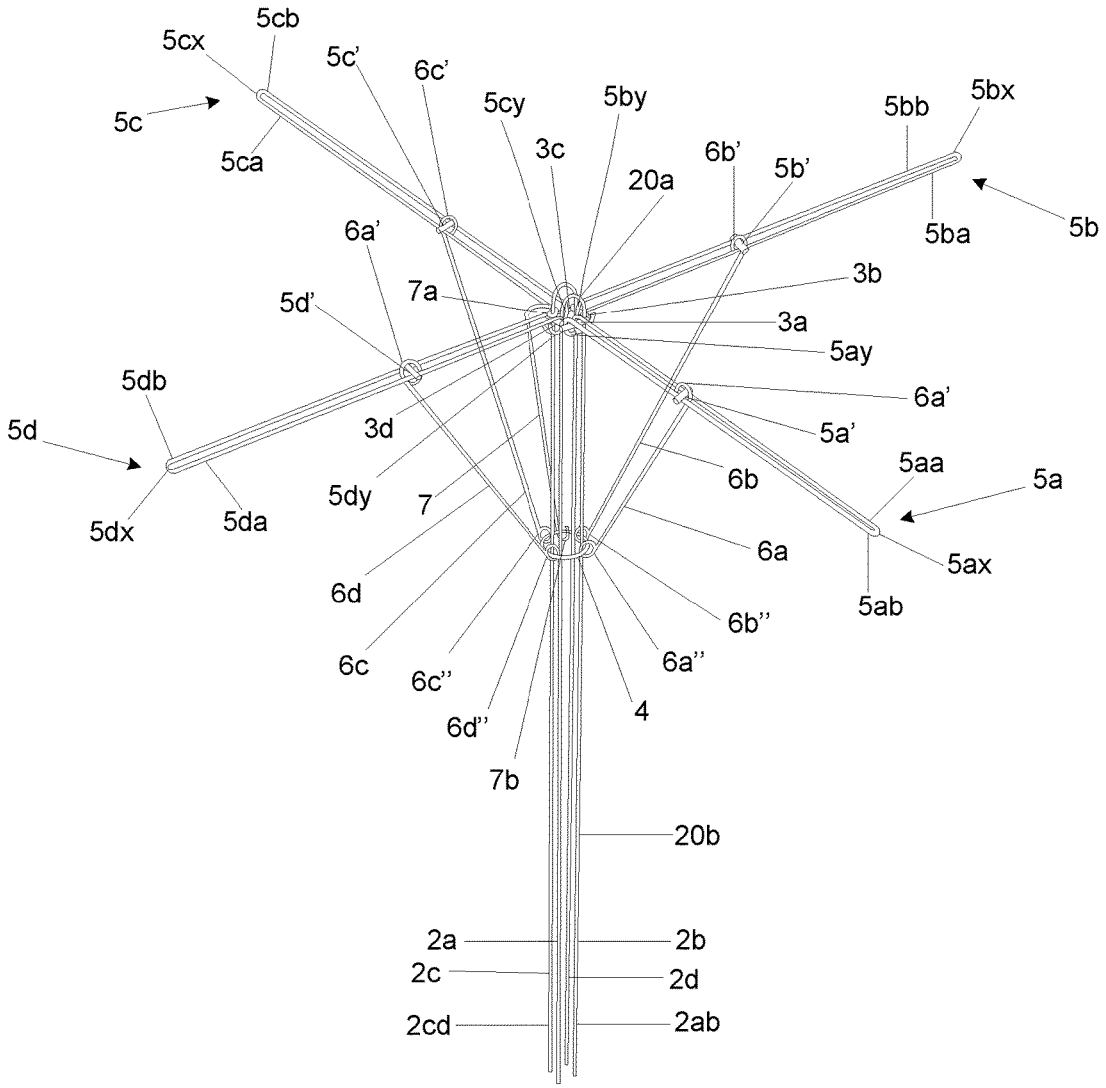
FIG. 2A illustrates a preferred embodiment of an umbrella frame according to the invention where the umbrella frame is open.

FIG. 1 shows two connectors 6*a* and 6*b* with their first ends 6*a*' and 6*b*' being connected to the arm spacer 5*a*' and 5*b*' of the arms 5*a* and 5*b*.

Figure 7:
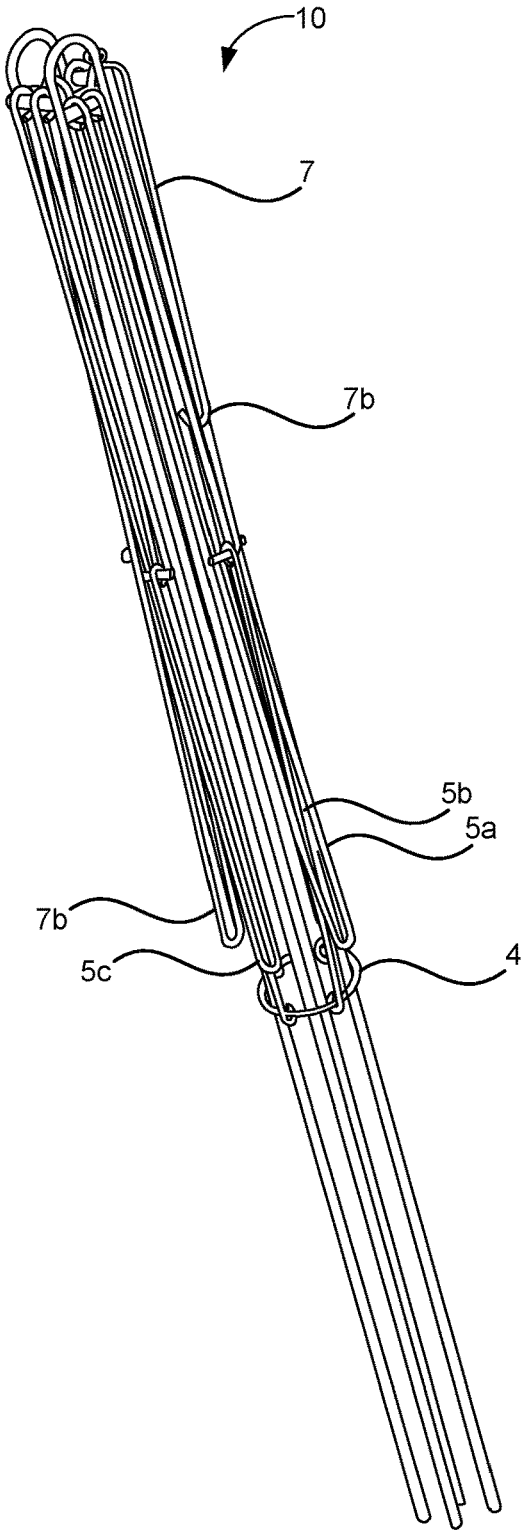
FIG. 7 is a side view of the umbrella of the invention being closed.

A locking element 7 is shown in FIG. 2A having two ends 7*a* and 7*b* with the first end 7*a* being hooked to the post 20 near its top end 20*a* and the second end 7*b* removably hooked to the lift ring 4. The locking element 7 engages the post 20 and the lift ring 4 and functions to keep the arms 5*a*, 5*b*, 5*c* and 5*d* in the upward and open position. When the umbrella frame 10 is to be closed as shown in FIG. 7, the second end 7*b* of the locking element 7 can be released from the lift ring 4 and the lift ring 4 can be moved downwards to bring the arms 5*a*, 5*b*, 5*c* and 5*d* in to close the umbrella.

Figure 19:
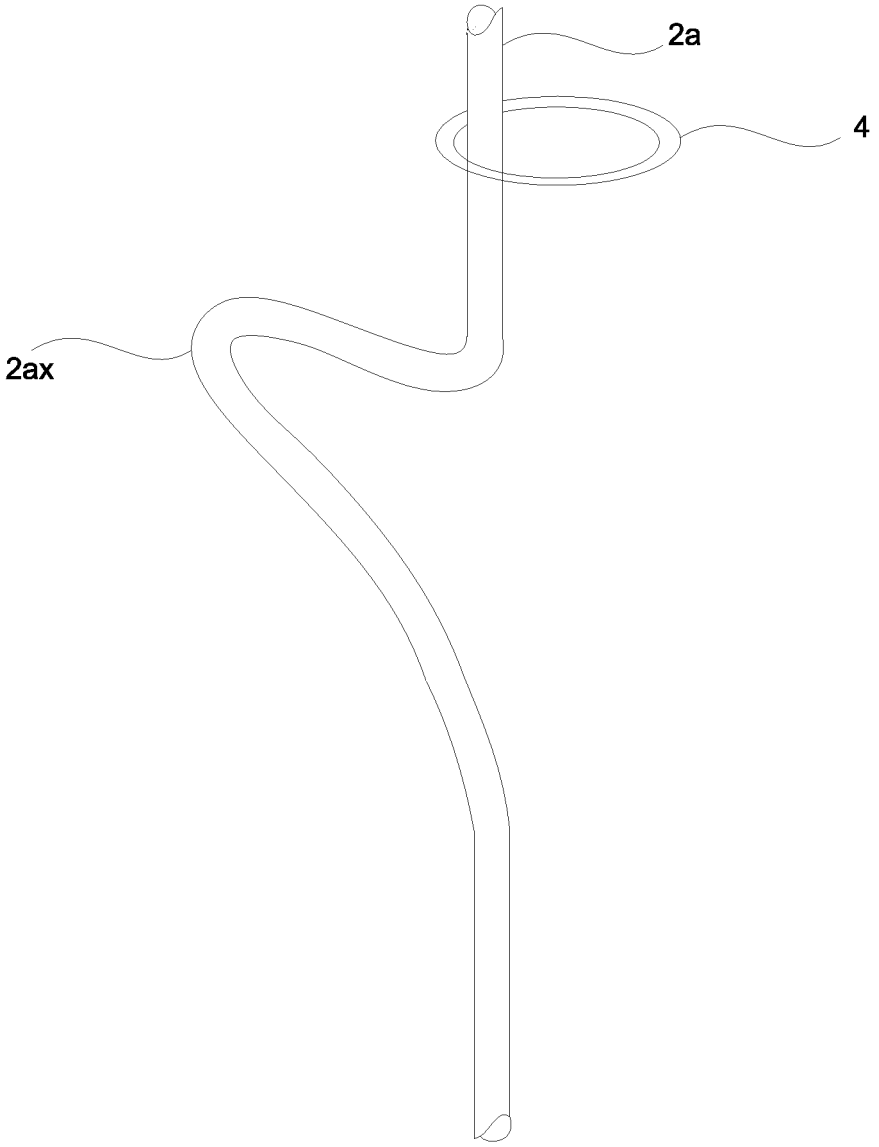
FIG. 19 illustrates a spring lock assembly in an alternative embodiment of the invention.
Figure 20A:
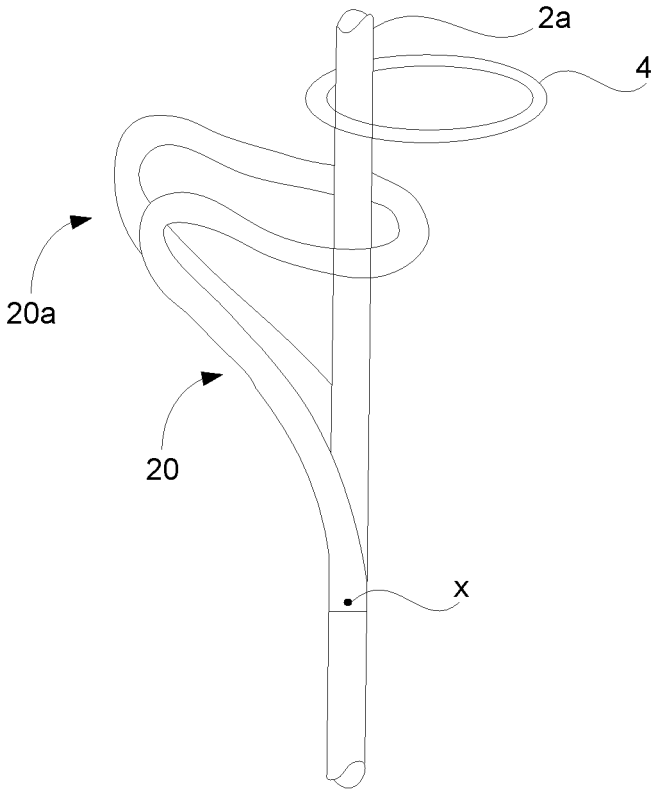
FIG. 20A-20B illustrates a modified spring lock assembly.
Figure 20B:
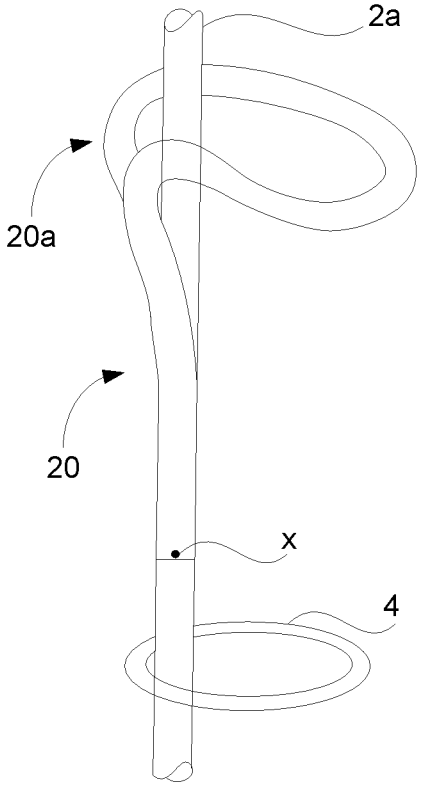

In yet another embodiment of the invention, the locking element 7 can be a press-button type mechanism to facilitate easy opening/closing of the umbrella frame 10 as shown in FIGS. 19, 20A, and 20B.

Figure 18A:
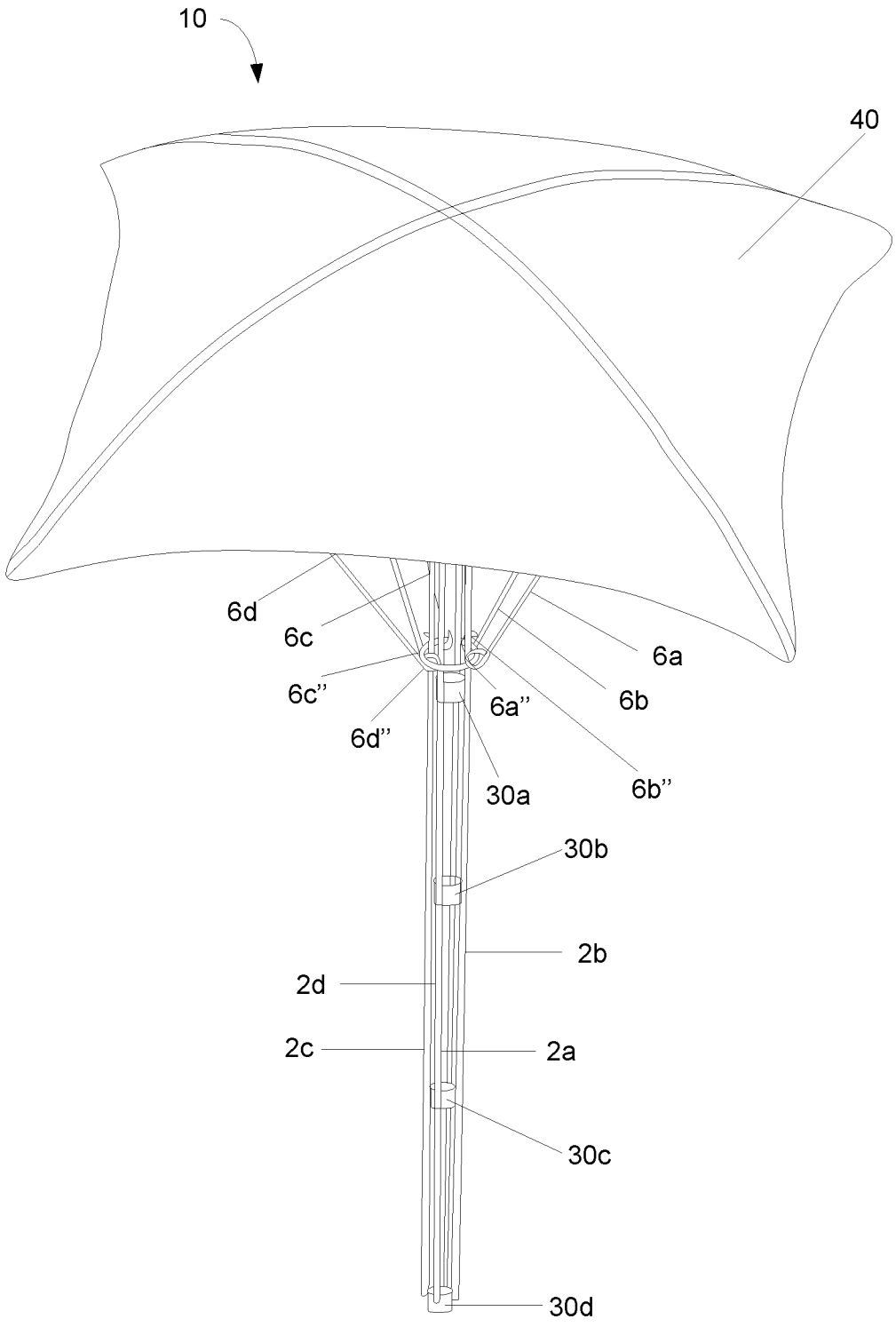
FIGS. 18A and 18B illustrate a fabric cover affixed to the arms of an umbrella frame.
Figure 18B:
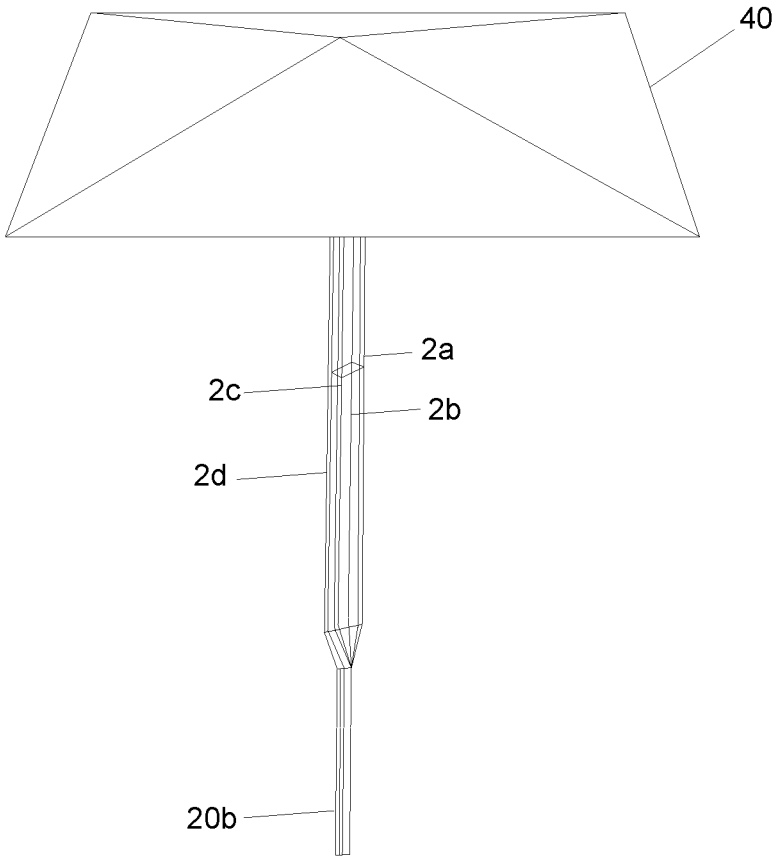

In yet another embodiment of the invention, a fabric canopy cover is affixed to the arms 5*a*, 5*b*, 5*c* and 5*d*. The cover provides shade and protection for the umbrella user or the garden plant as shown in FIG. 18A-18B.

In yet another embodiment of the invention, the fabric cover is made of any suitable material.

Figure 13A:
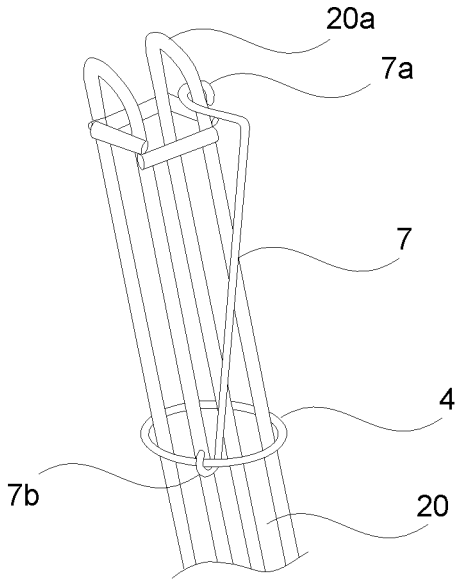
FIG. 13A shows a locking element engaging the post and the lift ring.
Figure 13B:
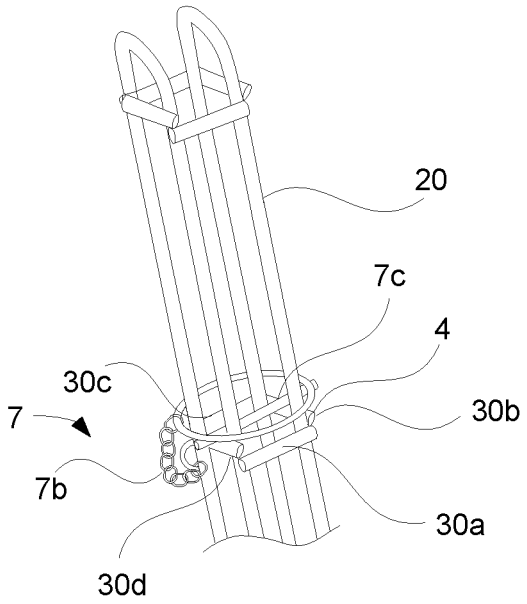
FIG. 13B is a view similar to FIG. 13A, where a locking element is a pin flexibly mounted to the lift ring.

With reference to FIG. 13A and FIG. 13B, two variations of the locking element 7 are depicted. As shown in FIG. 13A the locking element 7 with two ends 7*a* and 7*b* is shown. The first end 7*a* is hooked to the post 20 near its top end 20*a* and the second end 7*b* is removably hooked to the lift ring 4.

In yet another embodiment of the invention, as shown in FIG. 13B, the locking element 7 is in the form of a chain and pin assembly connected to the lift ring 4. The locking element includes a chain 7*b* and a pin 7*c*. Four spacers 30*a*, 30*b*, 30*c* and 30*d* are fixed on the post 20. When the locking element is to be engaged the pin is driven through the post 20 and rests alone the spacers 30*a*, 30*b*, 30*c* and 30*d* and below the lift ring.

Figure 12A:
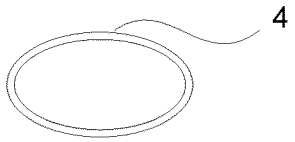
FIG. 12A-12E illustrates the alternatives for the lift ring.

In yet another embodiment of the invention, the lift ring 4 is a circular ring as shown in FIG. 12A. The lift ring 4 moves freely along the post 20 and performs the function of an element responsible for opening and closing of the umbrella frame 10.

Figure 12B:
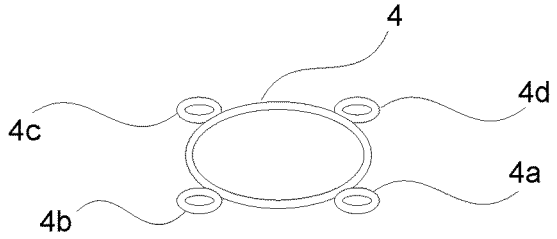

In yet another embodiment of the invention, as shown in FIG. 12B the lift ring 4 can have four loops 4*a*, 4*b*, 4*c* and 4*d* located outside along its periphery.

Figure 12C:
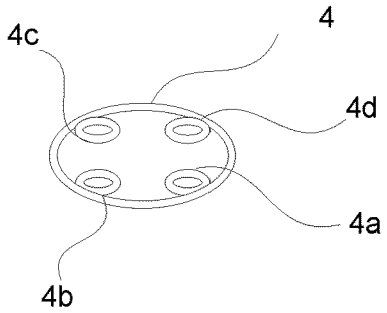

In yet another embodiment of the invention, as shown in FIG. 12C the loops 4*a*, 4*b*, 4*c* and 4*d* can be located inside the circumference of the lift ring 4.

Figure 12D:
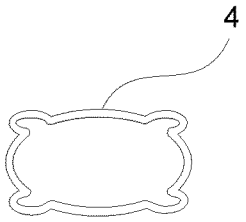

In yet another embodiment of the invention, the lift ring 4 can have bumps along its circumference as shown in FIG. 12D.

Figure 12E:
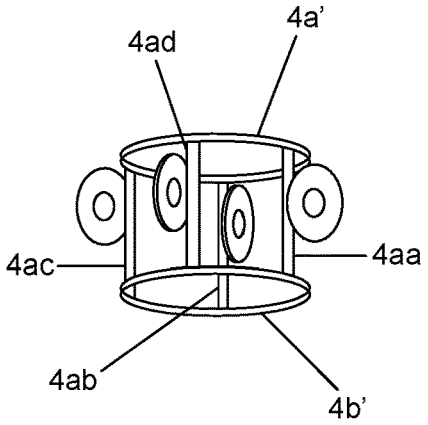

In yet another embodiment of the invention, the lift ring 4 can have two circular rings 4*a*' and 4*b*' as shown in FIG. 12E. The two circular rings 4*a*' and 4*b*' are separated using four spacers 4*aa*, 4*ab*, 4*ac* and 4*ad*. The lift ring 4 couples four rotatable disk members attached one each of the four spacers 4*aa*, 4*ab*, 4*ac* and 4*ad*.

In yet another embodiment of the invention, the lift ring 4 can have any other geometric shape suitable for working with the umbrella frame 10. The lift ring 4 may also include a push-button mechanism to hook/unhook the lift ring 4 from the locking element 7.

Figure 2B:
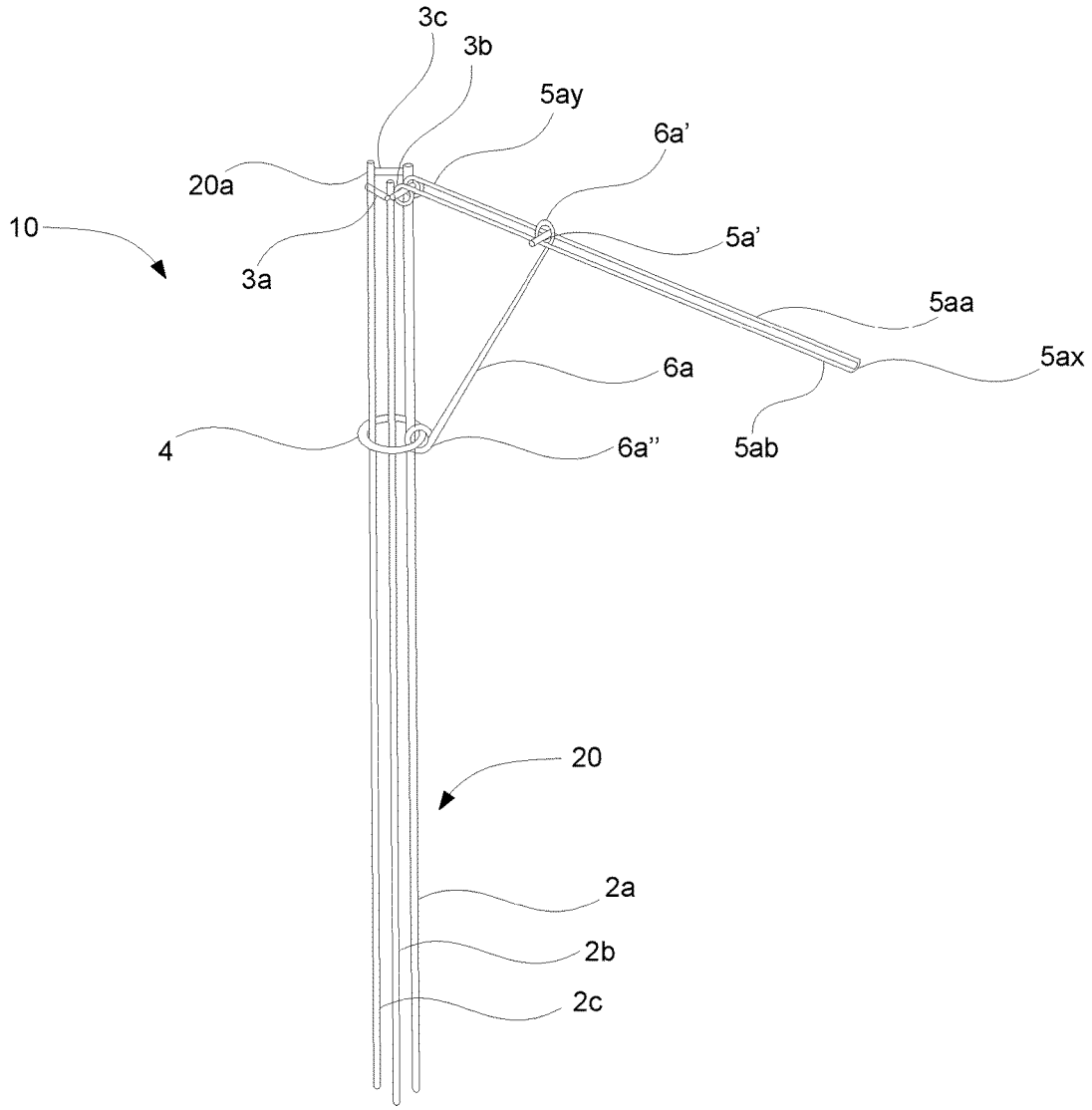
FIG. 2B and FIG. 2C are a perspective view of the post and a single arm connected by a connector.

With reference to FIG. 2B, three independent post rods 2*a*, 2*b* and 2*c* are shown which make up the post 20 of the umbrella frame 10. Post spacers 3*a*, 3*b* and 3*c* are provided in an outside configuration near the top end 20*a* of the post 20. The lift ring 4 is mounted circumferentially along the post 20. One arm 5*a* includes two wire elements formed of an integral half-bent wires 5*aa* and 5*ab* has one of its end 5*ax* formed as a "U" shape spacer and the other end 5*ay* hooked to the post spacer 3*b*. The arm 5*a* also includes an arm spacer 5*a*'. A connector 6*a* having a first end 6*a*' and a second end 6*a*" is also incorporated in the umbrella assembly 10. The first end 6*a*' of the connector 6*a* is hooked to the arm spacer 5*a*' and the second end 6*a*" is hooked to the lift ring 4.

Figure 2C:
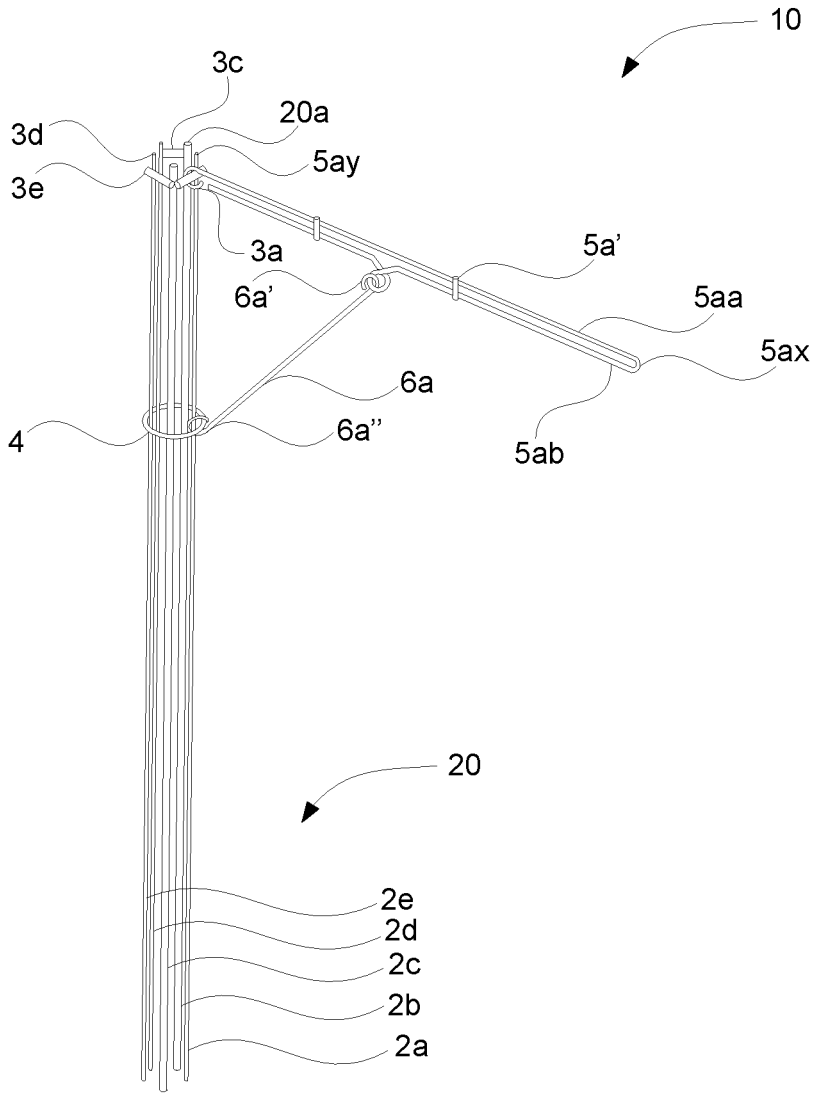

FIG. 2C shows another embodiment of the invention in which the post 20 includes five post rods 2*a*, 2*b*, 2*c*, 2*d* and 2*e*. The wires are bounded to each other with the help of five post spacer members 3*a*, 3*b* (not shown), 3*c*, 3*d* and 3*e* located near the top end 20*a* of the post 20. Post spacer members 3*a*, 3*b* (not shown), 3*c*, 3*d* and 3*e* and additional spacers mounted along the post (not shown) give mechanical strength to the post 20 and provide resistance against the bending of the post 20 under external forces. The post spacer members 3*a*, 3*b* (not shown), 3*c*, 3*d* and 3*e* are placed in an outside configuration with respect to the post rods 2*a*, 2*b*, 2*c*, 2*d* and 2*e*. The lift ring 4 is mounted circumferentially along the post 20. One arm 5*a* which includes 2 wire elements formed of an integral half-bent wires 5*aa* and 5*ab* and has a first curved end formed of an integral "U" shaped spacer 5*ax* and second end 5*ay* which is hooked to the upper post spacer 3*a*. The wires 5*aa* and 5*ab* lie in a vertical plane with respect to each other. The arm 5*a* also includes two arm spacers 5*a*' and 5*a*" rigidly fixed between the two wires plus the integral "U" shaped spacer. A connector 6*a* having a first end 6*a*' and a second end 6*a*" is also incorporated in the umbrella frame. The first end 6*a*' of the connector 6*a* is hooked to a loop formed in the wire 5*ab* of the arm 5*a* and the second end 6*a*" is hooked to the lift ring 4.

Figure 3:
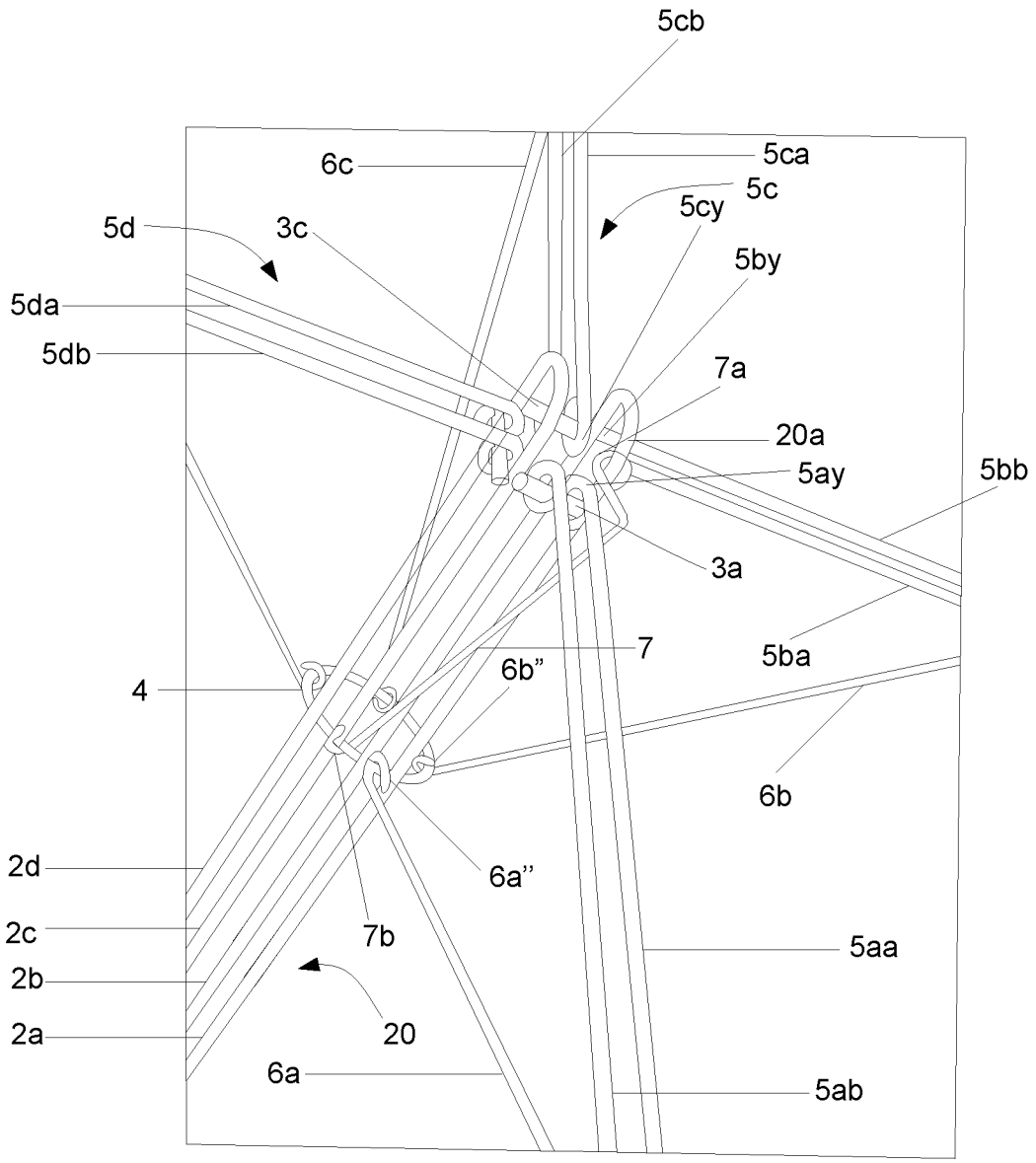
FIG. 3 illustrates the various connections and the locking element to the lift ring.

FIG. 3 is a perspective view showing four arms 5*a*, 5*b*, 5*c* and 5*d* coupled to the post 20 proximally at its top end 20*a* wherein the post 20 includes four post rods 2*a*, 2*b*, 2*c* and 2*d*. The arm 5*a* is made up of two wires 5*aa* and 5*ab*; similarly the arms 5*b*, 5*c* and 5*d* includes two wires 5*ba*, 5*bb*; 5*ca*, 5*cb* and 5*da*, 5*db* each. A lift ring 4 is mounted circumferentially around the post 20. The respective ends 5*ay*, 5*by*, 5*cy* and 5*dy* of the arms 5*a*, 5*b*, 5*c* and 5*d* are double hooked to the post spacer members 3*a*, 3*b*, 3*c* and 3*d* placed wherein the end 5*ay* includes the pair of wires 5*aa* and 5*ab* being bent in hook shape and similarly the ends 5*by*, 5*cy* and 5*dy* includes pair of wires 5*ba*, 5*bb*; 5*ca*, 5*cb* and 5*da*, 5*db* bent in hook configuration as shown in FIG. 3. A locking element 7 having two ends 7*a* and 7*b* is also depicted with the first end 7*a* being hooked near the top end 20*a* of the post 20 and the second end 7*b* removably connected to the lift ring 4. The upper post spacer members 3*a*, 3*b*, 3*c* and 3*d* act as an obstacle for the first end 7*a* of the locking element 7 and prevent it from sliding downwards. The configuration in which the ends 7*a* and 7*b* of the locking element 7 are hooked to the post 20 and the lift ring 4 resembles the state when the arms 5*a*, 5*b*, 5*c* and 5*d* are in open position. The connectors 6*a*, 6*b*, 6*c* and 6*d* have their second ends 6*a*", 6*b*", 6*c*" and 6*d*" connected to the lift ring 4 as depicted in FIG. 3.

Figure 4:
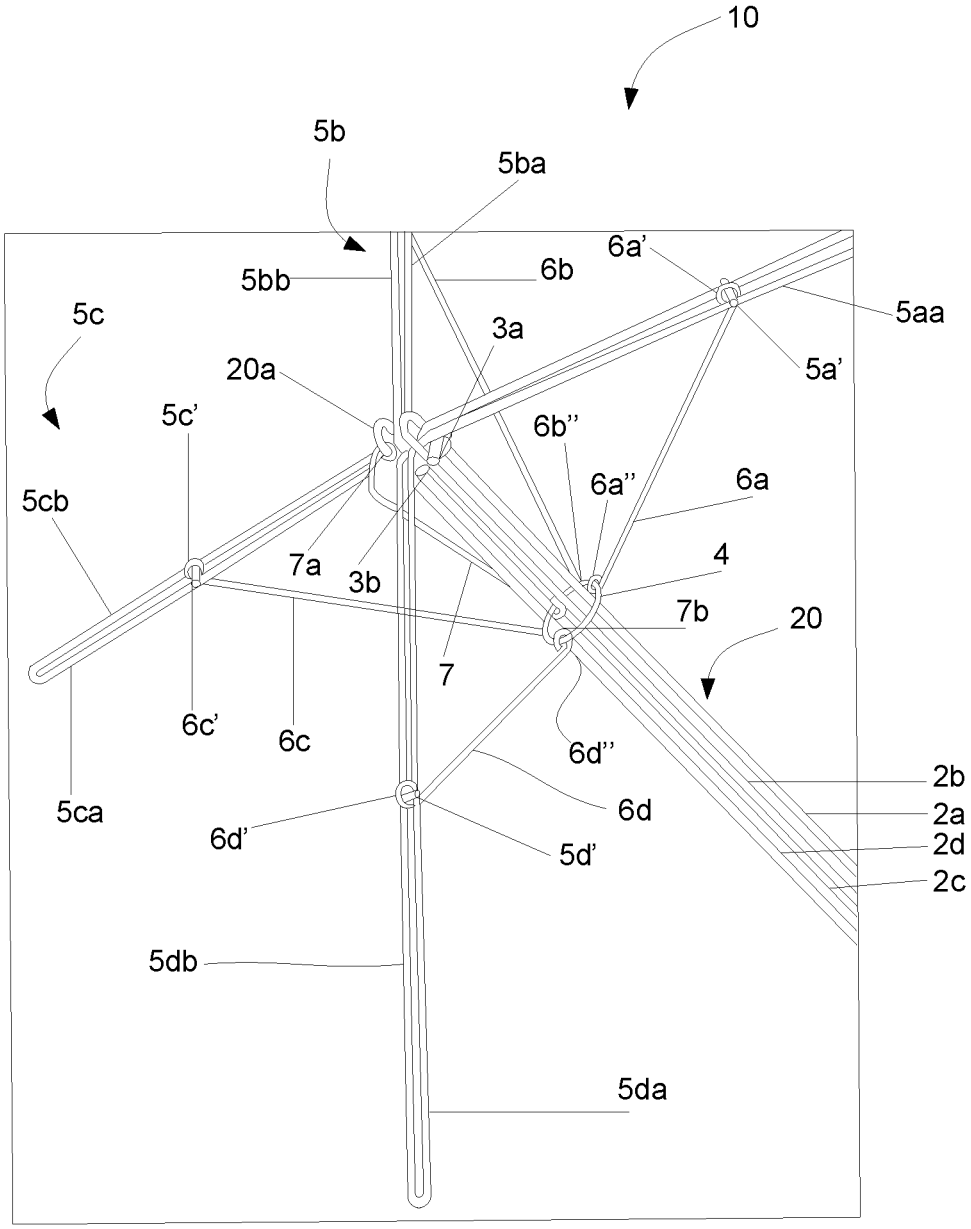
FIG. 4 is a top side view of the umbrella frame showing the post, arms, connectors, locking element and the lift ring.

FIG. 4 shows another perspective view of the umbrella frame 10 with the post 20 having a top end 20*a* to which four post spacer members 3*a*, 3*b*, 3*c* (not shown) and 3*d* (not shown) are attached. The post 20 includes 4 wires formed of two integral "U" shaped half-bent spaced post rods 2*a*, 2*b*, 2*c* and 2*d* respectively. A lift ring 4 is mounted circumferentially around the post 20 and has an end 7*b* of the locking element 7 hooked to it while the other end 7*a* is hooked to the post 20 near its top end 20*a*. The frame includes four arms 5*a*, 5*b*, 5*c* and 5*d* wherein the arm 5*d* is made up of two wires 5*da* and 5*db*, arm 5*b* is made up of two wires 5*ba* and 5*bb*, arm 5*c* is made up of two wires 5*ca* and 5*cb* and arm 5*a* is made up of two wires 5*aa* and 5*ab*. All the wires 5*aa*, 5*ab*; 5*ba*, 5*bb*; 5*ca*, 5*cb*; 5*da*, 5*db* of the four arms 5*a*, 5*b*, 5*c* and 5*d* are in half-bent configuration and lie in a horizontal plane with respect to each other.

In yet another embodiment of the invention, the wires 5*aa*, 5*ab*; 5*ba*, 5*bb*; 5*ca*, 5*cb*; 5*da*, 5*db* can be separate single wires.

As shown in FIG. 4, four upper arm spacer members 5*a*', 5*b*' (not shown), 5*c*' and 5*d*' are affixed to the arms 5*a*, 5*b*, 5*c* and 5*d* and the first ends 6*a*', 6*b*' (not shown), 6*c*' and 6*d*' of the connectors 6*a*, 6*b*, 6*c* and 6*d* are connected to the arm spacer members 5*a*', 5*b*' (not shown), 5*c*' and 5*d*' while the other ends 6*a*", 6*b*", 6*c*" and 6*d*" are connected to the lift ring 4.

Figure 5:
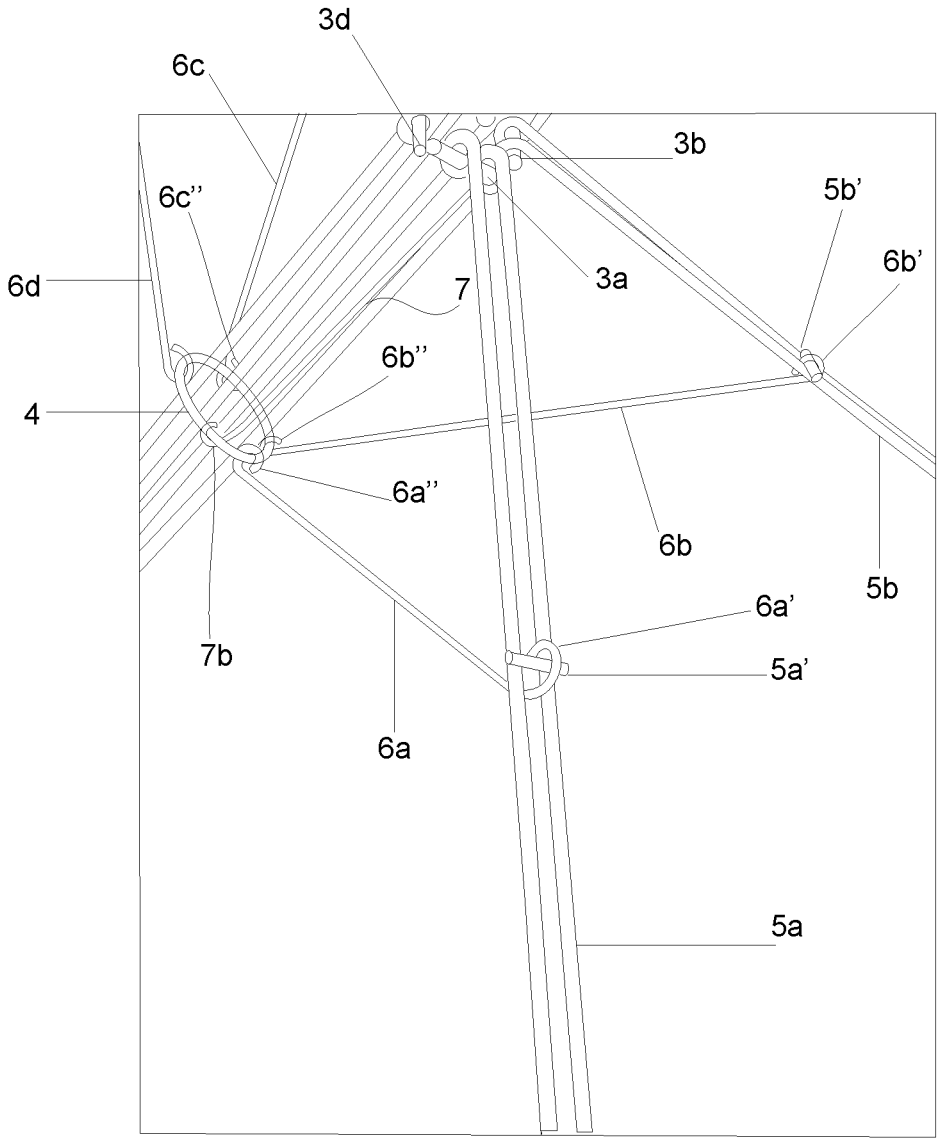
FIG. 5 is a side elevation of the umbrella frame of the invention showing the connectors being rotatably connected to the arms and the lift ring.

FIG. 5 illustrates the mechanism of hooking the first ends 6*a*' and 6*b*' of the connectors 6*a* and 6*b* to the arm spacers 5*a*' and 5*b*' of the arms 5*a* and 5*b*. Similarly the first ends 6*c*' (not shown) and 6*d*' (not shown) of the connectors 6*c* and 6*d* are connected to the spacers 5*c*' (not shown) and 5*d*' (not shown) of the arms 5*c* (not shown) and 5*d* (not shown). The lift ring 4 has the second ends 6*a*", 6*b*", 6*c*" and 6*d*" of the connectors 6*a*, 6*b*, 6*c* and 6*d* coupled to it. The locking element 7 has its second end 7*b* being hooked to the lift ring 4. The arms 5*a*, 5*b*, 5*c* (not shown) and 5*d* (not shown) are hooked to the upper post spacer members 3*a*, 3*b*, 3*c* (not shown) and 3*d* to be coupled to the post 20.

Figure 6:
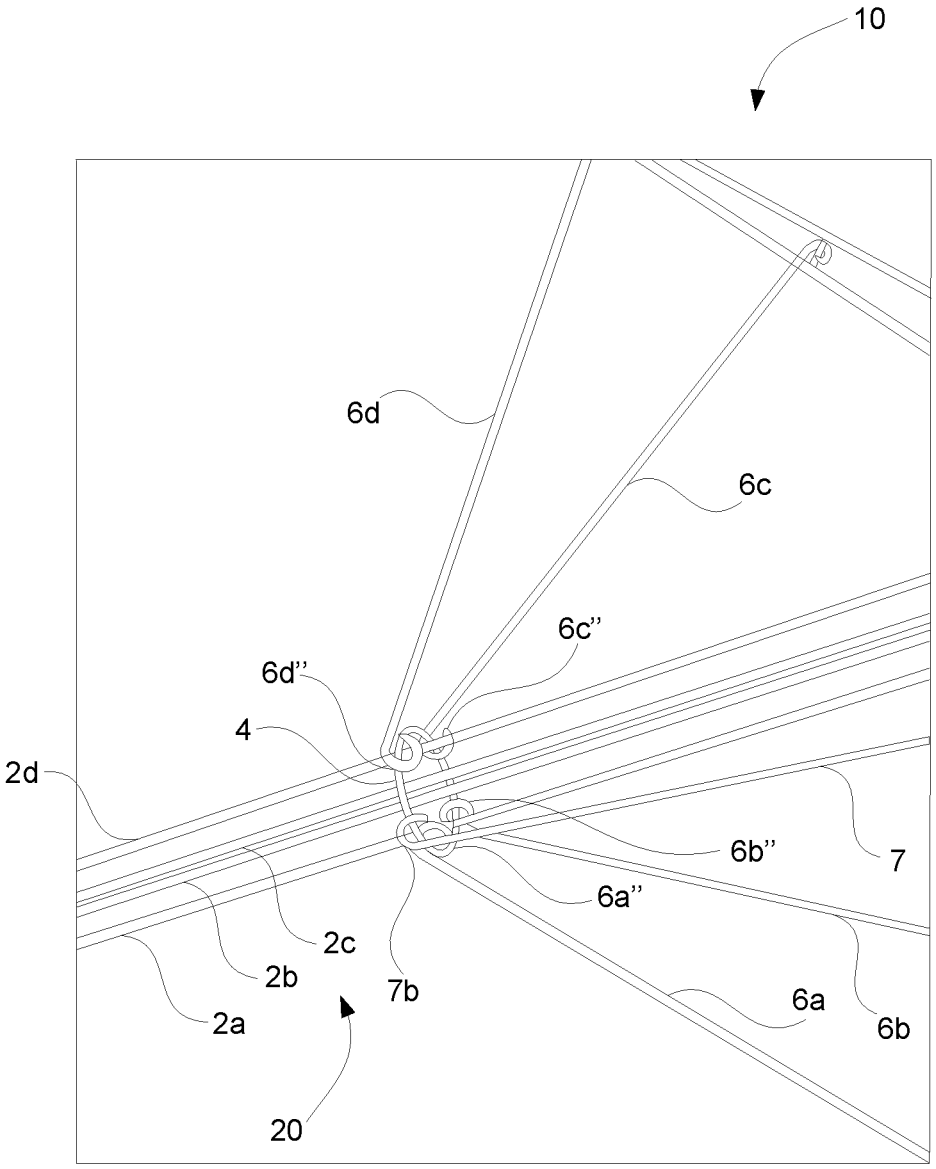
FIG. 6 illustrates the connectors being attached to the lift ring.
Figure 8:
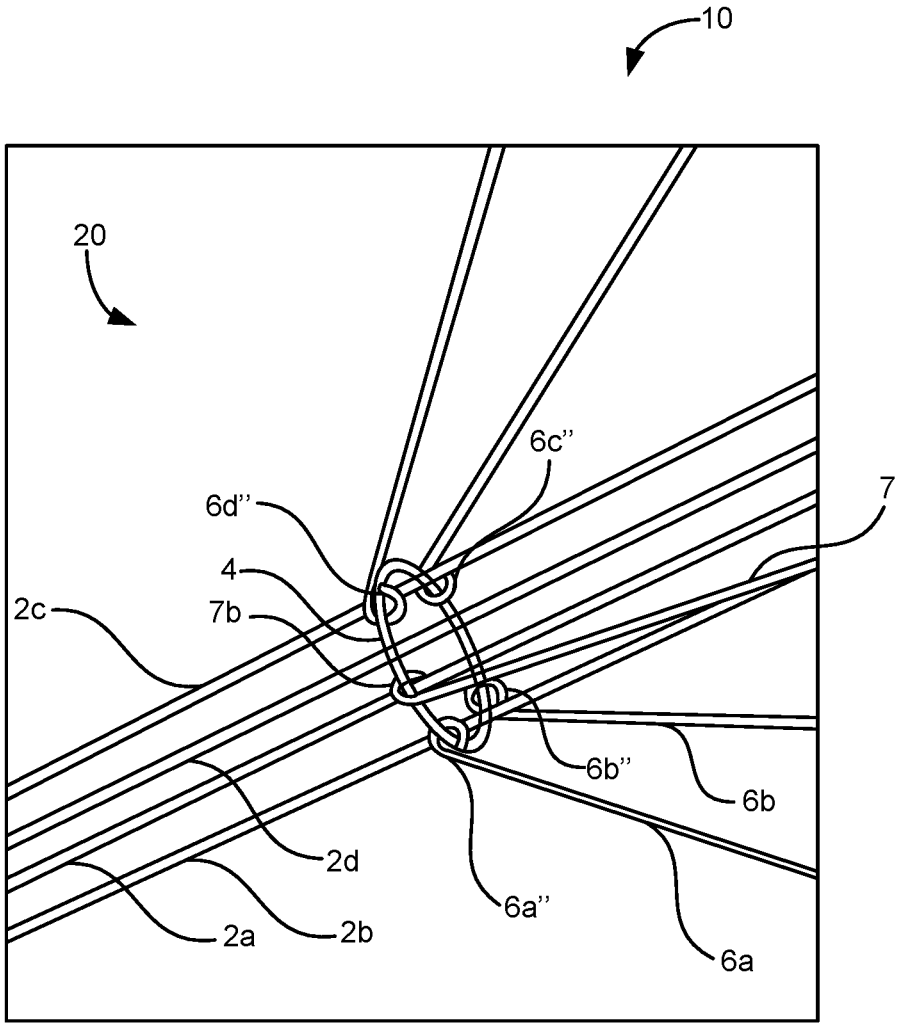
FIG. 8 illustrates the other end of the connectors and the locking element being attached to the lift ring.

FIG. 6 and FIG. 8 shows an arrangement of the four post rods 2*a*, 2*b*, 2*c* and 2*d* of the post 20 and the lift ring 4 held along the post 20 with the second ends 6*a*", 6*b*", 6*c*" and 6*d*" of the connectors 6*a*, 6*b*, 6*c* and 6*d* coupled to it. The second end 7*b* of the locking element 7 is hooked to the lift ring 4. As can be clearly seen in FIG. 6 and FIG. 8, the second ends 6*a*", 6*b*", 6*c*" and 6*d*" of the connectors 6*a*, 6*b*, 6*c* and 6*d* are shaped in the form of a hook for the purpose of being fixed to the lift ring 4. In yet another embodiment of the invention, the second ends 6*a*", 6*b*", 6*c*" and 6*d*" of the connectors 6*a*, 6*b*, 6*c* and 6*d* can have any other shape which serves the purpose of getting fixed to the lift ring 4.

In yet another embodiment of the invention, the lift ring 4 may accept locking members 7*b* to hold the second ends 6*a*", 6*b*", 6*c*" and 6*d*" of the connectors 6*a*, 6*b*, 6*c* and 6*d* in the upward position.

Figure 9:
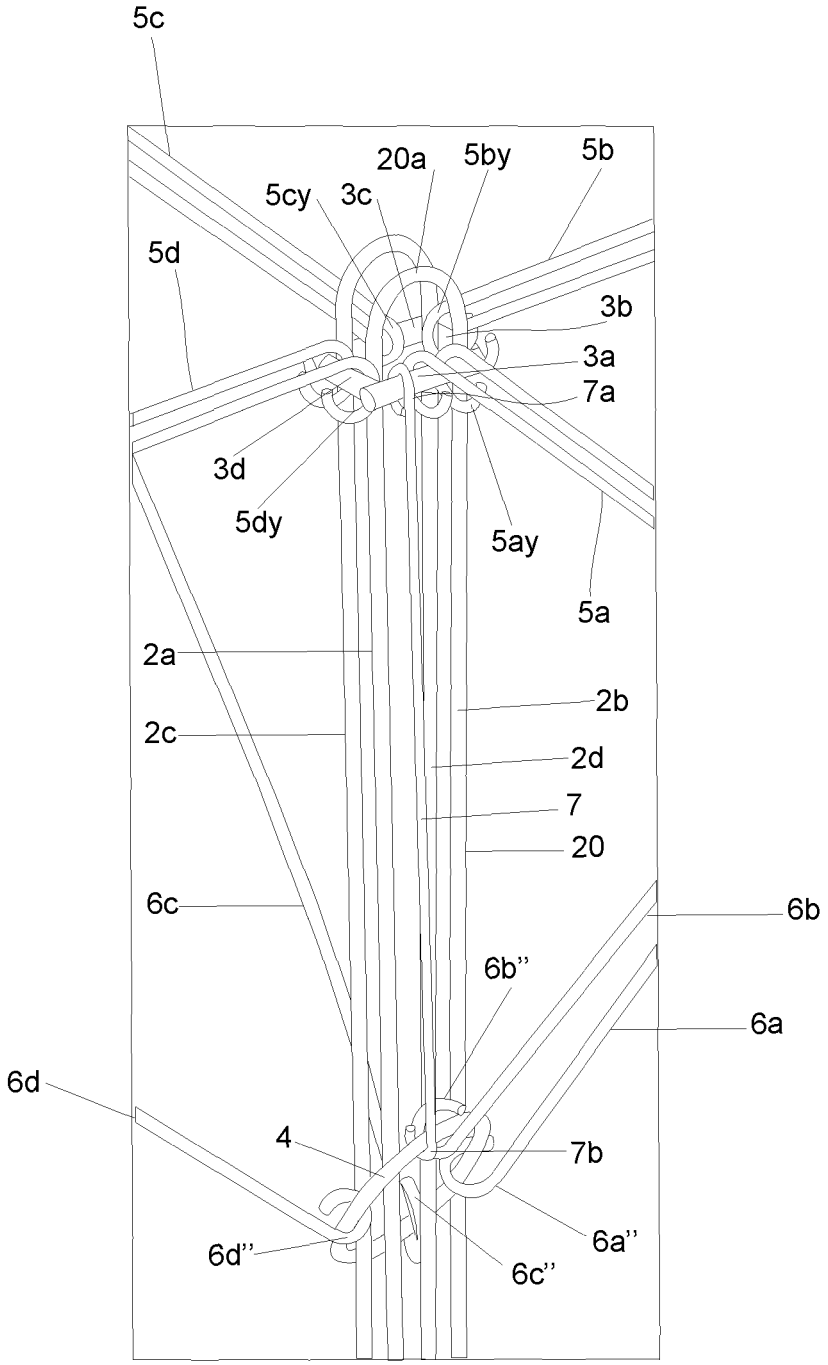
FIG. 9 shows the post, arms, lift ring, locking element and the other end of the connectors being hooked to the lift ring.

FIG. 9 illustrates the four post rods 2*a*, 2*b*, 2*c* and 2*d* of the post 20 wherein its four post rods 2*a*, 2*b*, 2*c* and 2*d* are made from two single wires by bending them into two sections. At the top end 20*a* of the post 20 upper post spacer members 3*a*, 3*b*, 3*c* and 3*d* are attached in an outside configuration to the post rods 2*a*, 2*b*, 2*c* and 2*d*. The ends 5*ay*, 5*by*, 5*cy* and 5*dy* of the arms 5*a*, 5*b*, 5*c* and 5*d* are hooked to the upper post spacers 3*a*, 3*b*, 3*c* and 3*d*.

In yet another embodiment of the invention, the ends 5*ay*, 5*by*, 5*cy* and 5*dy* of the arms 5*a*, 5*b*, 5*c* and 5*d* can be fixed in open position by welding to the post spacer members 3*a*, 3*b*, 3*c* and 3*d*, and the respective connector welded to the respective arms and to the post.

As shown in FIG. 9, a lift ring 4 is mounted circumferentially around the post 20 and the second ends 6*a*", 6*b*", 6*c*" and 6*d*" of the connectors 6*a*, 6*b*, 6*c* and 6*d* are connected to the lift ring 4. A locking element 7 having two ends 7*a* and 7*b* is used for the purpose of engaging the lift ring 4 and the post 20 to keep the arms 5*a*, 5*b*, 5*c* and 5*d* in the open position.

The first end 7*a* of the locking element 7 is attached to the post spacer 3*a* while the other end 7*b* is attached to the lift ring 4.

The first end 7*a* of the locking element 7 can have two different positions of attachment, firstly it can be connected directly to the top end 20*a* of the post 20 and secondly it can be attached to the post spacer 3*a* lying near the top end 20*a* of the post 20 as shown in FIG. 9.

In yet another embodiment of the invention, the first end 7*a* of the locking element 7 can be attached to any one of the post spacer members 3*a*, 3*b*, 3*c* and 3*d*.

In yet another embodiment of the invention, the locking element 7 may includes a plurality of wires.

Further, as can be seen in FIG. 9 the lift ring 4 is in tilted orientation, this is due to the load exerted on the lift ring 4 by the arms 5*a*, 5*b*, 5*c* and 5*d* when they are in the open position.

In yet another embodiment of the invention, the lift ring 4 can be a double ring to make it stronger.

FIG. 10A-10Q shows the various possible configurations of the post spacer members 3*a*, 3*b*, 3*c* and 3*d* to be fixed to the post rods 2*a*, 2*b*, 2*c* and 2*d*. As shown in FIG. 10A, the four post spacer members 3*a*, 3*b*, 3*c* and 3*d* are located in an outside configuration on the post rods 2*a*, 2*b*, 2*c* and 2*d*.

FIG. 10B illustrates the second possible configuration in which the post spacer members 3*a*, 3*b*, 3*c* and 3*d* are located inside the post rods 2*a*, 2*b*, 2*c* and 2*d*. The third configuration of the post spacer members 3*a*, 3*b*, 3*c* and 3*d* being placed in-between the post rods 2*a*, 2*b*, 2*c* and 2*d* is illustrated in FIG. 10C.

In yet another embodiment of the invention, as shown in FIG. 10D a ball bearing 3' acts as a spacer joining the post rods 2*a*, 2*b*, 2*c* and 2*d* together.

In yet another embodiment of the invention, as depicted in FIG. 10E three post spacer members 3*a*, 3*b* and 3*c* binds three independent post rods 2*a*, 2*b* and 2*c* together for providing mechanical stability and strength. The spacer members in FIG. 10E are placed outside the three post rods 2*a*, 2*b*, and 2*c*. The arrangement of the post spacer members 3*a*, 3*b*, and 3*c* inside the three post rods 2*a*, 2*b* and 2*c* is shown in FIG. 10F whereas the post spacer members 3*a*, 3*b*, and 3*c* being placed in-between the three wires 2*a*, 2*b* and 2*c* is shown in FIG. 10G.

In yet another embodiment of the invention, a ball bearing 3' binds the three wires 2*a*, 2*b* and 2*c* together as shown in FIG. 10H.

The FIGS. 10I-10L shows an embodiment of the invention in which the post 20 includes five post rods 2*a*, 2*b*, 2*c*, 2*d* and 2*e*. As shown in FIG. 10I five post spacer members 3*a*, 3*b*, 3*c*, 3*d* and 3*e* are arranged outside the post rods 2*a*, 2*b*, 2*c*, 2*d* and 2*e*. The arrangement of the post spacer members 3*a*, 3*b*, 3*c*, 3*d* and 3*e* inside the post rods 2*a*, 2*b*, 2*c*, 2*d* and 2*e* is shown in FIG. 10J while the arrangement of the post spacer members 3*a*, 3*b*, 3*c*, 3*d* and 3*e* in-between the post rods 2*a*, 2*b*, 2*c*, 2*d* and 2*e* is illustrated in FIG. 10K.

In yet another embodiment of the invention, a single cylindrical block or plug 3' replaces the post spacer members 3*a*, 3*b*, 3*c*, 3*d* and 3*e* to bind together the post rods 2*a*, 2*b*, 2*c*, 2*d* and 2*e* as shown in FIG. 10L.

FIG. 10M represents the post rods 2*a*, 2*b*, 2*c* and 2*d* made from sections of two half-bent wires and the post rods 2*a*, 2*b*, 2*c* and 2*d* being held together by a cylindrical block 3'.

In yet another embodiment of the invention, the cylindrical block 3' can have any other geometrical shape like oval, elliptical, rectangular.

In yet another embodiment of the invention, there can be a plurality of cylindrical blocks 3' to bind the post rods 2*a*, 2*b*, 2*c* and 2*d* together.

FIG. 10N shows another possible design of the post 20 which is made up of three post rods 2*a*, 2*b* and 2*c* rigidly joined to each other along their length or a portion of their length. FIG. 10O depicts three post rods 2*a*, 2*b* and 2*c* and a post spacer 3*a* in the form of a ring enclosing the post rods 2*a*, 2*b* and 2*c*. FIG. 10P depicts three post rods 2*a*, 2*b* and 2*c* and a post spacer 3*a* in the form of a ring held inside the post rods 2*a*, 2*b* and 2*c*. FIG. 10Q shows four post rods 2*a*, 2*b*, 2*c* and 2*d* separated by a post spacer 3*a* in the form of a horizontal cylinder block.

Figure 11A:
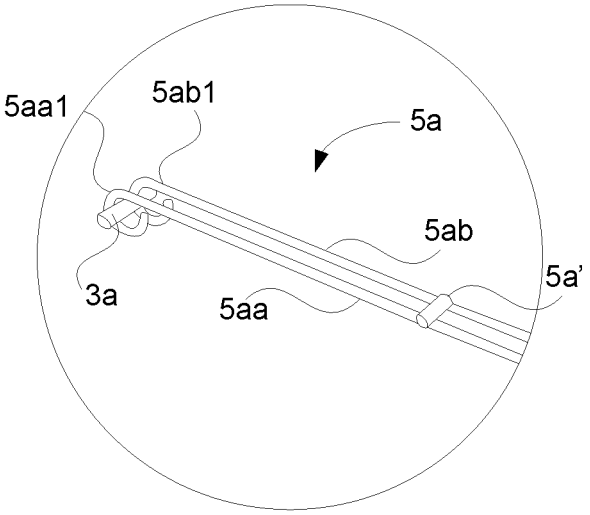
FIG. 11A-11G shows various design alternatives for the arms of the umbrella frame.

FIG. 11A-11G shows various structural orientations which the arms 5*a*, 5*b*, 5*c* and 5*d* of the umbrella frame 10 can possess. FIG. 11A illustrates an arm 5*a* having two wires 5*aa* and 5*ab* with an arm spacer 5*a'* fixed intermediately on it. The wires 5*aa* and 5*ab* has one of their ends 5*aa*1 and 5*ab*1 twisted in the form of a hook and attached to the post spacer member 3*a*. Further, the wires 5*aa* and 5*ab* are lying in a horizontal plane with respect to each other.

Figure 11B:
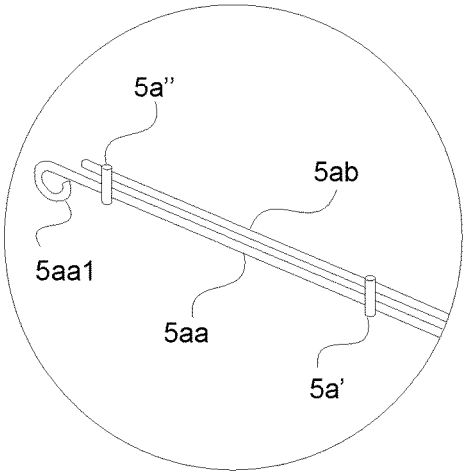

FIG. 11B shows an arm 5*a* with the two wires 5*aa* and 5*ab* in vertical orientation with respect to each other. Two arm spacers 5*a'* and 5*a"* are mounted on the arm 5*a*. The end 5*aa*1 of the wire 5*aa* is twisted in the form of a hook.

In yet another embodiment of the invention, the arm spacers 5*a'* and 5*a"* can be welded on the arm 5*a*.

In yet another embodiment of the invention, the arm 5*a* can have any plurality of spacers mounted on it.

Figure 11C:
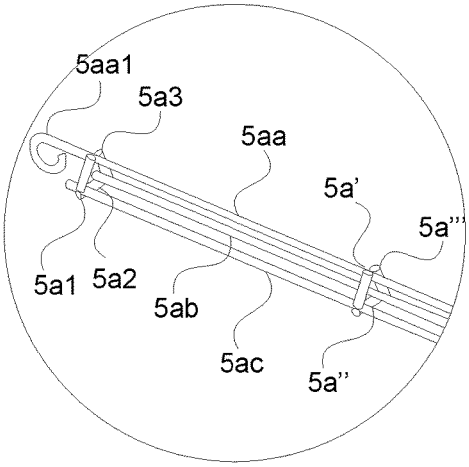
Figure 11D:
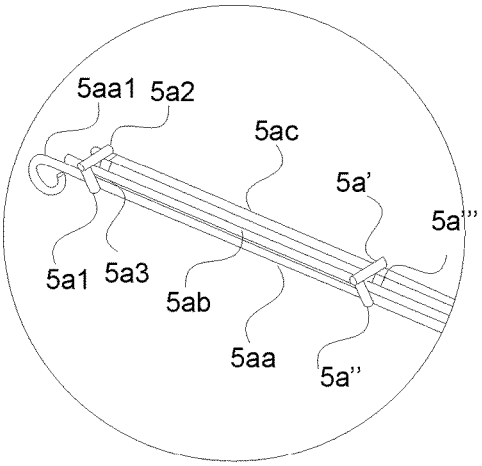

FIG. 11C and FIG. 11D show two different views of an arm 5*a* including three arm wires 5*aa*, 5*ab* and 5*ac*. The arm wires 5*aa*, 5*ab* and 5*ac* are placed in a triangular orientation with respect to each other. Arm spacer members 5*a'*, 5*a"* and 5*a'"* are fixed at an intermediate location on the wires 5*aa*, 5*ab* and 5*ac*. Another set of three spacer members 5*a*1, 5*a*2, 5*a*3 are located on the arm 5*a* near its inner end. The spacer members 5*a'*, 5*a"*, 5*a'"*, 5*a*1, 5*a*2 and 5*a*3 are fixed at an outside configuration on the three wires 5*aa*, 5*ab* and 5*ac*. The end 5*aa*1 of the wire 5*aa* is shaped in the form of a hook to be connected to the post. The spacer members 5*a'*, 5*a"*, 5*a'"*, 5*a*1, 5*a*2 and 5*a*3 provide strength to the arm 5*a* and make it more resistant to bending and increases its overall mechanical stability.

Figure 11E:
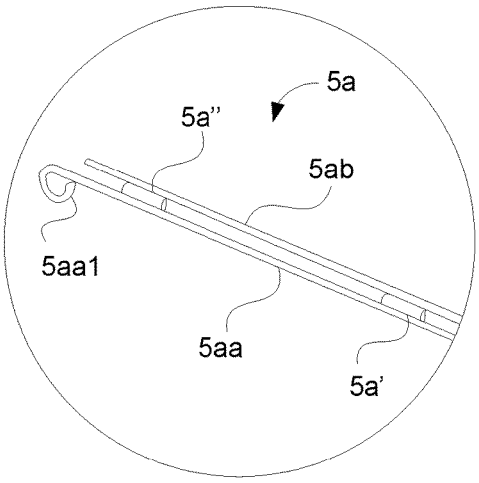
Figure 11F:
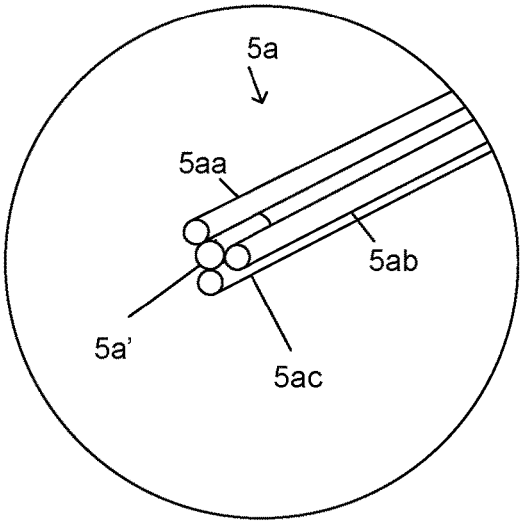
Figure 11G:
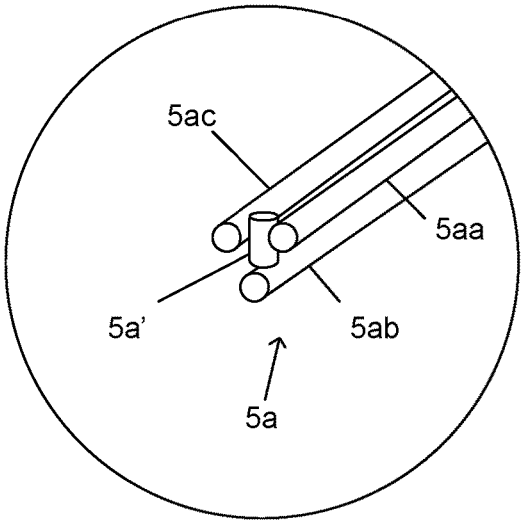
Figure 11H:
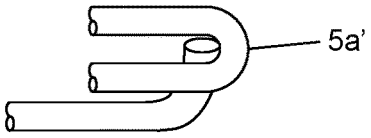
FIGS. 11H(i) and 11H(ii) shows end "U" shaped spacers with two wire and three wire configurations respectively according to an embodiment herein.
Figure 11H:
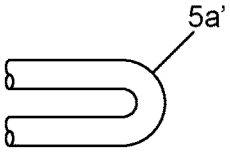

FIG. 11E shows arm portion 5*a* including two wires 5*aa* and 5*ab*. The wires are separated using two arm spacers 5*a'* and 5*a"*. FIG. 11F shows arm portion 5*a* including three wires 5*aa*, 5*ab*, and 5*ac*. The three wires 5*aa*, 5*ab*, and 5*ac* are separated using an arm spacer 5*a'*. FIG. 11G shows arm portion 5*a* including three wires 5*aa*, 5*ab* and 5*ac*. The three wires 5*aa*, 5*ab* and 5*ac* are separated using an arm spacer 5*a'*. FIG. 11H(i) shows end "U" arm spacer 5*a'* of 5*aa* and 5*ab* wires. FIG. 11H(ii) shows end "U" arm spacer 5*a'* of 5*aa*, 5*ab* and 5*ac* wires. In one embodiment, the wires may also be replaced by rods.

In yet another embodiment of the invention, the arm spacers 5*a'*, 5*a"*, 5*a'"*, 5*a*1, 5*a*2 and 5*a*3 can be replaced by any supporting elements which serve the purpose of binding the arm wires together.

FIG. 14A shows another embodiment of the invention in which the arm 5*a* includes two wires or rods 5*aa* and 5*ab* formed from an integral "U" bent wire. The wires 5*aa* and 5*ab* are in half-bent configuration and have four spacers 5*a*1, 5*a*2, 5*a*3 and 5*a*4 affixed to the arm 5*a* in an outside position with an end "U" spacer. The two wires 5*aa* and 5*ab* lie in a horizontal plane with respect to each other and one end 5*ay* of the arm 5*a* which includes the pair of wires 5*aa* and 5*ab* shaped in the form of a hook and connected to a post spacer 3*a*.

FIG. 14B shows an embodiment of the invention in which the post 20 having a top end 20*a* and a bottom end 20*b* is made up of four post rods 2*a*, 2*b*, 2*c* and 2*d*. The two post rods 2*a* and 2*b* are made from a single integral half-bent wire and the wires 2*c* and 2*d* are made from another single integral half-bent wire. The wires 2*c* and 2*d* are made from another single integral half bent wire. The "U" bend forming an end spacer. Four spacer members 11, 12, 13, 14 of four spacer members each are placed along the length of the post 20. The spacer 11 includes four spacer members 11*a*, 11*b*, 11*c* and 11*d*, the spacer 12 includes four spacer members 12*a*, 12*b*, 12*c* and 12*d*, the spacer 13 includes four spacer members 13*a*, 13*b*, 13*c* and 13*d* and the spacer 14 includes four spacer members 14*a*, 14*b*, 14*c* and 14*d*. All the spacer members 11*a*, 11*b*, 11*c*, 11*d*, 12*a*, 12*b*, 12*c*, 12*d*, 13*a*, 13*b*, 13*c*, 13*d*, 14*a*, 14*b*, 14*c* and 14*d* are affixed in an outside position with respect to the post rods 2*a*, 2*b*, 2*c* and 2*d*.

In yet another embodiment of the invention, the spacer members 11*a*, 11*b*, 11*c*, 11*d*, 12*a*, 12*b*, 12*c*, 12*d*, 13*a*, 13*b*, 13*c*, 13*d*, 14*a*, 14*b*, 14*c* and 14*d* can be affixed in an inside or in-between the post rods 2*a*, 2*b*, 2*c* and 2*d*.

Figure 14C:
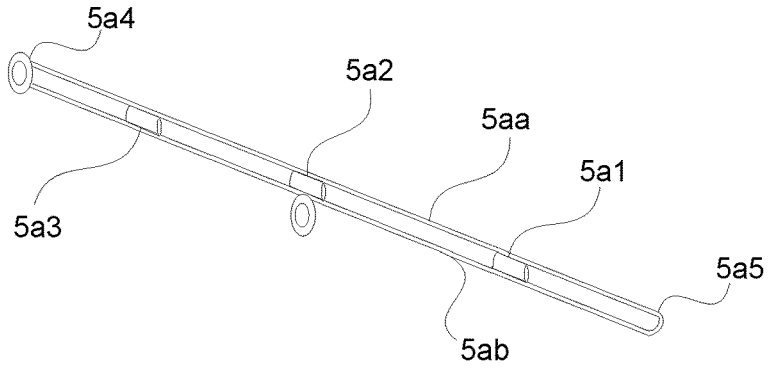
FIG. 14C illustrates three spacers distributed evenly along the arm with a "U" bend for the outer end spacer and a spacer disk connector.
Figure 14C:
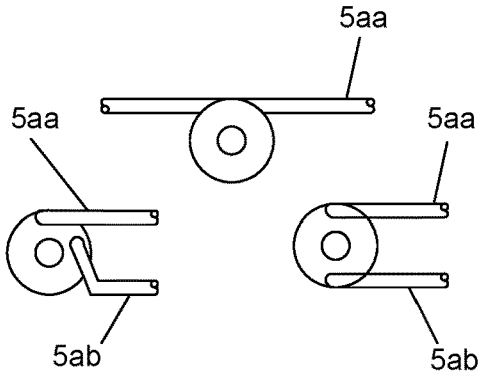

FIG. 14C illustrates three spacers 5*a*1, 5*a*2 and 5*a*3 distributed evenly along the arm. The three spacers 5*a*1, 5*a*2 and 5*a*3 space the arm 5*aa* from 5*ab*. The arm also includes "U" end spacer 5a5 and a disk spacer 5a4. FIG. 14C(i) shows various modes of attaching the disk spacer to the arm 5aa and 5ab.

Figure 14D:
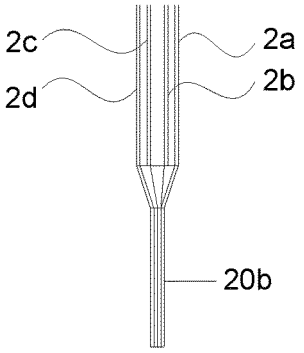
FIG. 14D illustrates an alternate bottom portion of the post with the rods joined as a spacer.

FIG. 14D illustrates bottom portion 20b of the post 20. At the bottom, the post rods 2a, 2b, 2c and 2d converge to form the bottom blade portion 20b, the binding of which provides a spacer.

In FIGS. 15A, 15B and 15C various structure are shown in which in the connector 6a can be attached to the arm 5a. In FIG. 15A the connector 6a having a first end 6a' and second end 6a" is attached to the arm 5a by having its first end 6a' hooked to an arm spacer 5a' lying intermediately on the arm 5a. The second end 6a" of the connector 6a will be connected to the lift ring 4 (not shown). Further, one end 5ay of the arm 5a which includes the pair of wires 5aa and 5ab shaped in the form of a hook and connected to a post spacer 3a.

FIG. 15B illustrates an embodiment of the invention in which the arm 5a includes two wires 5aa and 5ab wherein the wire 5aa has a loop formed at an intermediate position. The wires 5aa and 5ab are oriented in a vertical plane with respect to each other. Four arm spacers 5a', 5a", 5a'" and 5a"" are fixed on the arm 5a with two spacers on each vertical face of the arm 5a. The connector 6a has its first end 6a' hooked to the loop formed in the wire 5aa. The end 5aa1 of the wire 5aa is shaped in the form of a hook to be connected to the post 20. Each arm includes an end integral "U" spacer.

In yet another embodiment of the invention, the first end 6a' connector 6a can be hooked to multiple loops formed in the wires 5aa and 5ab (not shown).

In yet another embodiment of the invention, the wires 5aa and 5ab can have a plurality of loops formed on them (not shown).

FIG. 15C shows the wires 5aa and 5ab of the arm 5a in vertical orientation with respect to each other and two arm spacers 5a' and 5a" affixed to the arm 5a. The wire 5aa has a loop formed at an intermediate position and the first end 6a' of the connector 6a is hooked to the loop of the wire 5aa for being connected to the arm 5a. The end 5ab1 of the wire 5ab is curved in the form of a hook to be connected to the post 20.

In yet another embodiment of the invention, the any number of spacers can be evenly distributed along the post and the arms.

Figure 15D:
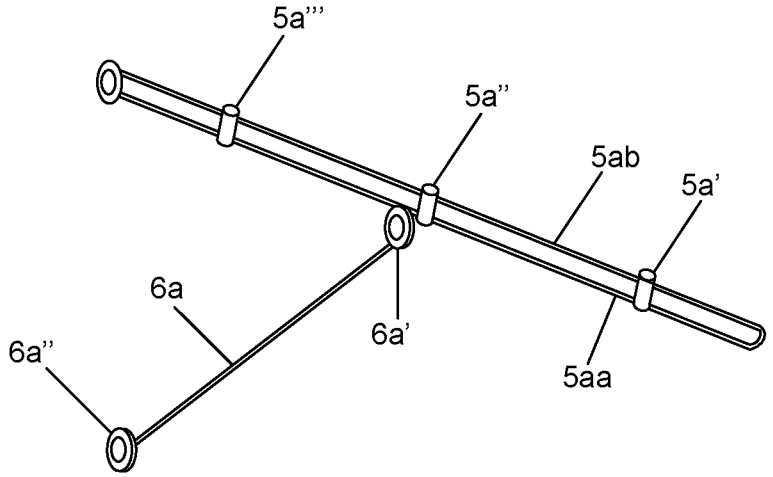

FIG. 15D shows the wires 5aa and 5ab separated using vertical pin as arm spacers 5a'. The first end 6a' of the connector 6a is attached to an arm rotatable connection member and the second end 6a" of the connector 6a is to be attached to a rotatable connection member on the lift ring (not shown).

FIG. 16 shows an alternate embodiment of the umbrella frame 10 in which four cylindrical block spacers 30a, 30b, 30c and 30d are placed longitudinally along the post rods 2a, 2b, 2c and 2d of the post 20. The top of the post rods 2a, 2b, 2c and 2d are also bound to each other by four post spacer members 3a, 3b, 3c and 3d located near the top end 20a of the post 20 with the "U" bend in post wire 2a/2b and in 2c/2d forming respective partial integral "U" spacer.

The umbrella frame 10 further includes a movable lift ring 4 mounted circumferentially around the post 20. Four arms 5a, 5b, 5c and 5d are coupled to the post 20 proximally at its top end 20a. The arm 5a is made up of two wires 5aa and 5ab wherein the two wires 5aa and 5ab are made from a single half-bent integral "U" bend spacers at the outer end of each arm. Similarly the arms 5b, 5c and 5d includes two wires 5ba, 5bb; 5ca, 5cb; 5da, 5db each as shown in FIG. 16.

One end 5ax, 5bx, 5cx and 5dx of each of the 2 wire arms 5a, 5b, 5c and 5d is a curved "U" spacer due to the half-bent wire configuration of the arms 5a, 5b, 5c and 5d while the other ends 5ay, 5by, 5cy and 5dy wherein the end 5ay includes the pair of wires 5aa, 5ab being bent in the form of a hook and similarly the ends 5by, 5cy and 5dy 5ba includes the wires 5ba, 5bb; 5ca, 5cb; 5da, 5db respectively being bent in the form of a hook and connected to the post spacers 3a, 3b, 3c and 3d respectively. This hook type attachment of the ends 5ay, 5by, 5cy and 5dy permits free rotation of the arms 5a, 5b, 5c and 5d along the post spacers 3a, 3b, 3c and 3d respectively.

The umbrella frame 10 also includes four connectors 6a, 6b, 6c and 6d. Each of connector 6a, 6b, 6c and 6d has first ends 6a', 6b', 6c' and 6d' and second ends 6a", 6b", 6c" and 6d". The connector 6a has its first end 6a' directly connected to the arm 5a and its second end 6a" connected to the lift ring 4. Similarly the connectors 6b, 6c and 6d have their first ends 6b', 6c' and 6d' directly connected to the arms 5b, 5c, 5d and the second ends 6b", 6c" and 6d" connected to the lift ring 4. The movable lift ring 4 facilitates the opening and closing of the arms 5a, 5b, 5c and 5d by moving freely along the post 20.

In yet another embodiment of the invention, the first ends 6a', 6b', 6c' and 6d' of the connectors 6a, 6b, 6c and 6d are welded on the arms 5a, 5b, 5c and 5d.

In yet another embodiment of the invention, the first ends 6a', 6b', 6c' and 6d' of the connectors 6a, 6b, 6c and 6d can be fixed on the arms 5a, 5b, 5c and 5d by any suitable methods of joining two members.

A locking element 7 is shown in FIG. 16 having two ends 7a and 7b with the first end 7a being hooked to the post 20 near its top end 20a and the second end 7b hooked to the lift ring 4. The locking element 7 engages the post 20 and the lift ring 4 and functions to keep the arms 5a, 5b, 5c and 5d in the open position.

Figure 17:
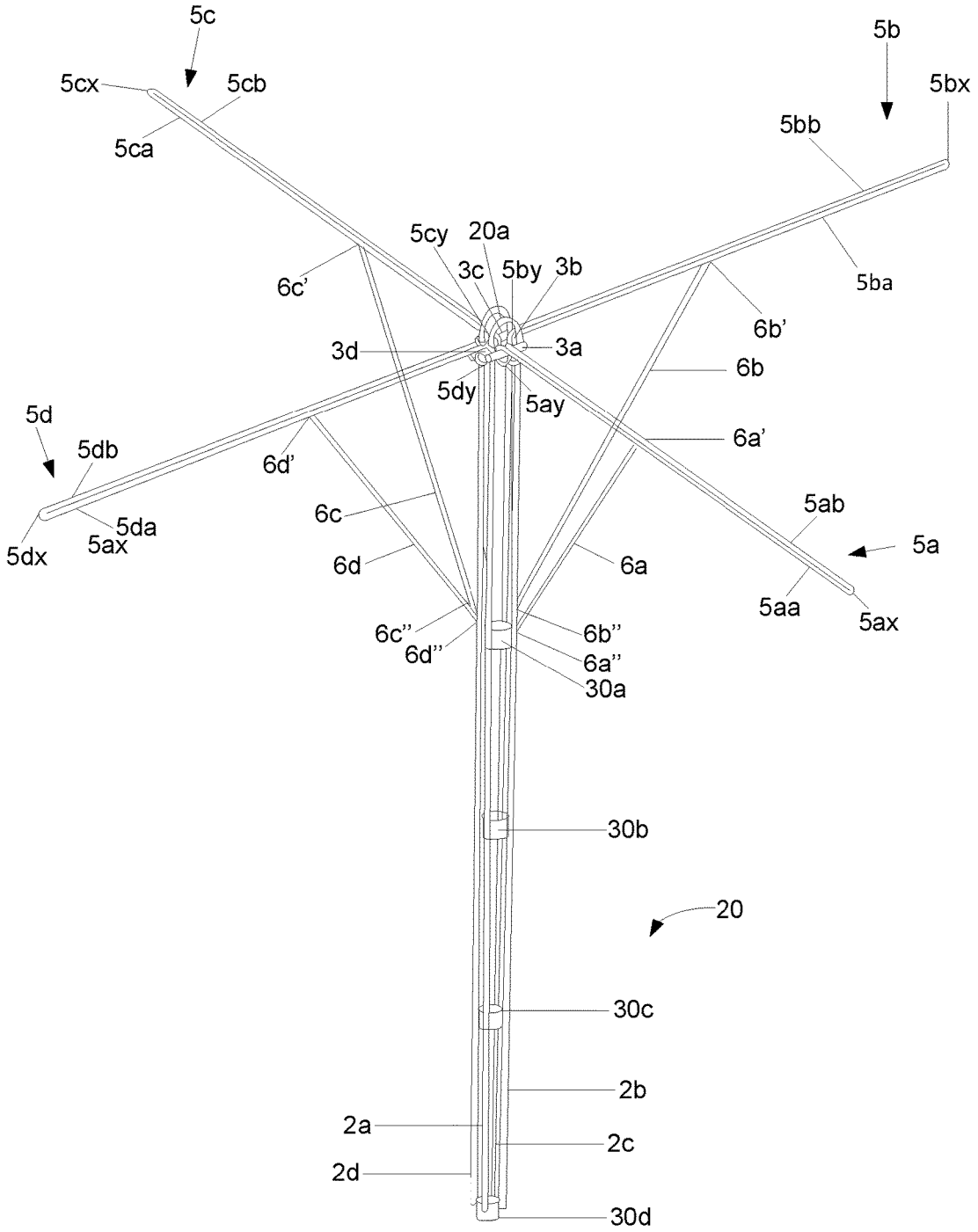
FIG. 17 illustrates another design assembly of the umbrella frame with the connectors fixed to the arms and the post.

FIG. 17 shows another modified embodiment of the umbrella frame 10 in which four cylindrical spacer members 30a, 30b, 30c and 30d are placed longitudinally along the post rods 2a, 2b, 2c and 2d of the post 20. The post rods 2a, 2b, 2c and 2d are also bound to each other by a spacer of four post spacer members 3a, 3b, 3c and 3d located near the top end 20a of the post 20.

The umbrella frame 10 further includes four arms 5a, 5b, 5c and 5d are coupled to the post 20 proximally at its top end 20a. The arm 5a is made up of two wires 5aa and 5ab wherein the wires 5aa and 5ab are made from a single half-bent wire. Similarly the arms 5b, 5c and 5d includes half-bent integral wires 5ba, 5bb; 5ca, 5cb; 5da, 5db each as shown in FIG. 17.

One end 5ax, 5bx, 5cx and 5dx of each of the arms 5a, 5b, 5c and 5d is curved "U" shaped spacer due to the half-bent wire configuration of the arms 5a, 5b, 5c and 5d and the other ends 5ay, 5by, 5cy and 5dy wherein the end 5ay includes two wires 5aa, 5ab being bent in the form of a hook and similarly the ends 5by, 5cy and 5dy 5ba includes two wires 5ba, 5bb; 5ca, 5cb; 5da, 5db each respectively being bent in the form of a hook and connected to the post spacer members 3a, 3b, 3c and 3d respectively.

The umbrella frame 10 also includes four connectors 6a, 6b, 6c and 6d. Each of connector 6a, 6b, 6c and 6d has first ends 6a', 6b', 6c' and 6d' and second ends 6a", 6b", 6c" and 6d". The connector 6a has its first end 6a' directly connected to the arm 5a and its second end 6a" directly connected to the post 20. Similarly the connectors 6b, 6c and 6d have their first ends 6*b*', 6*c*' and 6*d*' directly connected to the arms 5*b*, 5*c*, 5*d* and the second ends 6*b*", 6*c*" and 6*d*" directly connected to the post 20.

In yet another embodiment of the invention, the first ends 6*a*', 6*b*', 6*c*' and 6*d*' and the second ends 6*a*", 6*b*", 6*c*" and 6*d*" of the connectors 6*a*, 6*b*, 6*c* and 6*d* are welded on the arms 5*a*, 5*b*, 5*c*, 5*d* and the post 20.

In yet another embodiment of the invention, the first ends 6*a*', 6*b*', 6*c*' and 6*d*' and the second ends 6*a*", 6*b*", 6*c*" and 6*d*" of the connectors 6*a*, 6*b*, 6*c* and 6*d* can be fixed on the arms 5*a*, 5*b*, 5*c*, 5*d* and the post 20 by any suitable methods of joining two members.

The umbrella frame 10 shown in FIG. 17 is a fixed open umbrella category and remains in the open position.

FIG. 18A depicts a working model of the umbrella frame 10 having a fabric cover 40 affixed to arched shaped arms 5*a* (not shown), 5*b* (not shown), 5*c* (not shown) and 5*d* (not shown) of the umbrella frame 10. Four cylindrical blocks 30*a*, 30*b*, 30*c* and 30*d* are placed longitudinally along the post rods 2*a*, 2*b*, 2*c* and 2*d* of the post 20. Further, four connectors 6*a*, 6*b*, 6*c* and 6*d* having their second ends 6*a*", 6*b*", 6*c*" and 6*d*" directly connected to the post 20 can be seen in FIG. 18A.

FIG. 18B shows a working model of the umbrella frame 10 having a fabric cover 40 affixed to straight arms 5*a* (not shown), 5*b* (not shown), 5*c* (not shown) and 5*d* (not shown) of the umbrella frame 10 perpendicularly to the post rods 2*a*, 2*b*, 2*c*, and 2*d*.

FIG. 19 depicts a spring lock mechanism in an alternative embodiment of the present invention. The post rod 2*a* is pressed inwardly to create a locking bend 2*ax* which permits the ring 4 to slip over the locking bend and to retain the ring 4 in the upward position.

In yet another embodiment of the invention, multiple wires may include the spring lock structure of locking bend to retain the ring 4 in an upward position.

In yet another embodiment of the invention, the bending or twisting of the wire 2*a* can be done in any suitable shape or form to retain the ring 4.

With reference to FIG. 20A and FIG. 20B another modified spring lock structure is discussed. As shown in FIG. 20A the spring lock assembly 20 includes a twisted wire 20*a* which is fixed to the post rod 2*a* at location X. The spring lock assembly 20 can be fixed at location X by means of welding or any other joining method like use of fasteners, screw etc. The ring 4 is located at an upward position with respect to the spring lock assembly 20 in FIG. 20A. The fixation of lock assembly 20 at location X on the post rod 2*a* permits the lock assembly 20 to move inwardly and outwardly with respect to the post rod 2*a*. When it is desired to bring the ring 4 to a downward position the lock assembly 20 can be pressed inwards to come closer to the post rod 2*a* and the ring 4 is passed over it and moved to a downwards position as shown in FIG. 20B.

In yet another embodiment of the invention, the spring lock assembly 20 can be attached to multiple wires of the umbrella frame.

The use of spacers in the present invention to join the plurality of wires in the post, arms and the connectors is of exemplary significance. The structure of the spacers between the plurality of wires for the post, arms and connectors provides additional strength against bending at a lower weight and mass of a solid member of the same outside dimensions. The application of spacers as a reinforcement member is being put to model use in the present invention and the increase in mechanical strength and stability provided to each component i.e. the post, arms and connectors with the use of spacers yields visible results and benefits. Thus, the spacers are an essential and necessary element of the present invention.

The umbrella frame 10 has the advantages of being easily assembled and manufactured. The locking mechanism used in the umbrella is relatively easy and the complete structure is lightweight and strong. The umbrella frame 10 lends greater strength and stability to the umbrella which increases its life and also its usage in extreme and challenging weather conditions. The umbrella can be easily closed by sliding down the lift ring 4 along the post 10 which reduces it space occupation while not in use. Further, the assembled wires can be replaced or fixed with ease, if incase any repair is required to the umbrella frame 10.

The umbrella frame 10 can be used in a variety of applications. This umbrella frame can be used in the day-to-day hand umbrella and the large, standing outdoor umbrellas which are commonly utilized at restaurants, bars, hotels, and other places that offer outdoor seating so as to shield people from the sun, as well as from other elements of nature, such as wind, light rain, etc. The umbrella frame can be built for small, medium as well as large sized umbrellas and sizes can range from 12 inches to 9 feet in diameter. The umbrella frame lends flexibility and rigidity to the umbrella structure and hence proves to be a better design.

The rigidity and density of all the parts of the umbrella frame 10 can be tempered for a desired flexibility as needed. The post, arms, lift ring and connectors may be included of metal, wood or fiberglass but not limited to these rigid compositions. Thermoplastic materials can also be used to fabricate the umbrella frame as they offer a degree of flexibility in the members of the umbrella frame. These plastics have a degree of flexibility, and distribute the impact energy on the frame through all of the plastic components of the umbrella. This increases the life of the umbrella frame 10 which is generally the more costly portion of an umbrella unit. The other materials of the wires used in making the post and the arms can be but not limited to wooden dowels, bamboo, small rigid tubing, PVC (Polyvinyl chloride), plastic etc.

Figure 21:
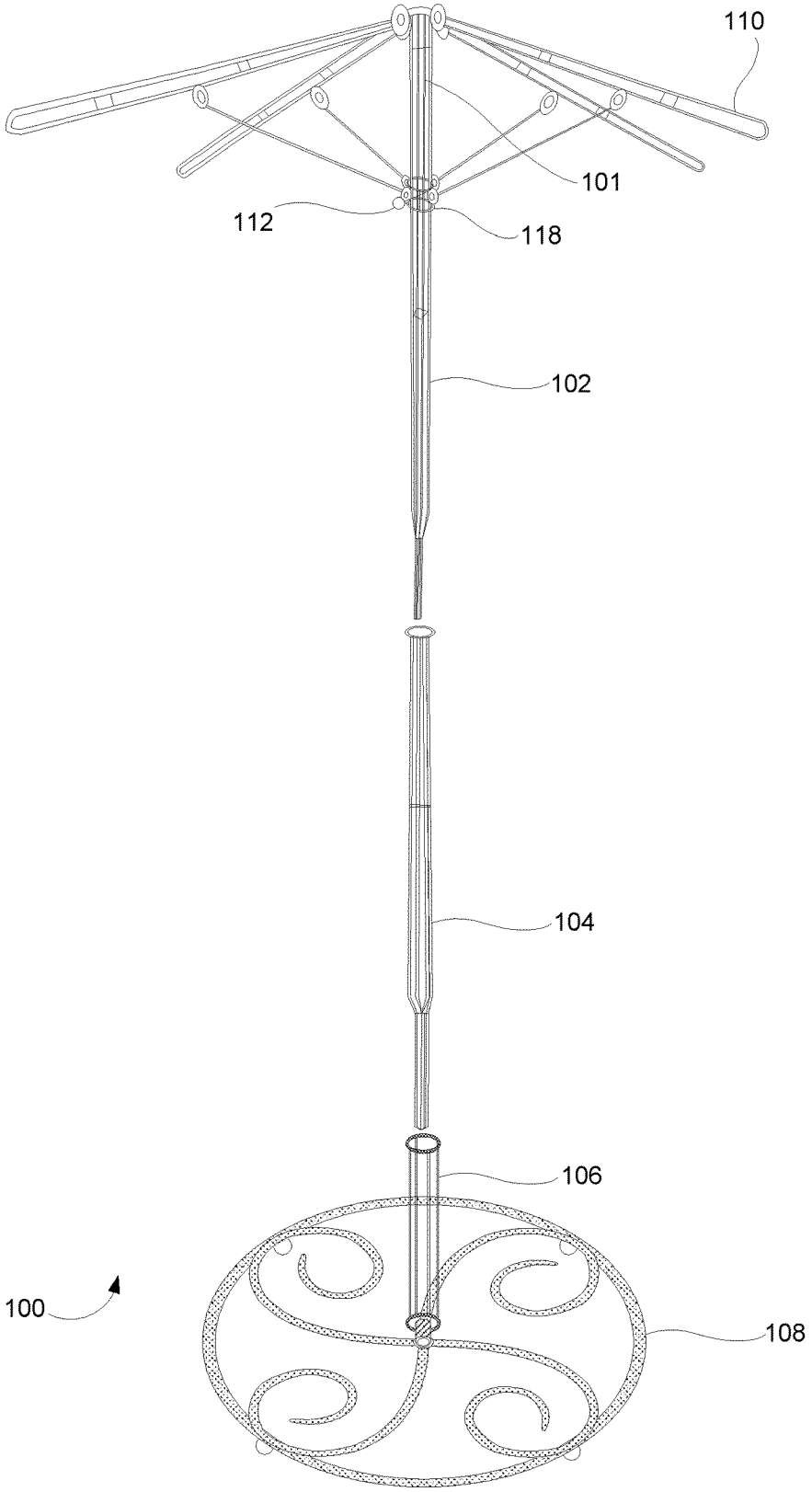
FIG. 21 is a perspective view of an umbrella assembly including a frame, an extension and a base according to an embodiment herein.

FIG. 21 is a perspective view of an umbrella assembly 100 according to an embodiment herein. The umbrella assembly 100 includes a frame 101 including a post 102, an extension post 104, and an umbrella base including an upright 106 and a platform 108. The post 102 includes a top and bottom, which further consists of a plurality of post rods, a plurality of arms 110, a lift ring 118, and a lift ring lock 112 with a pin to lock the plurality of arms 110 at a particular position (not shown). The plurality of arms 110 further consists of a plurality of wires.

In one embodiment, each arm includes an inside end and an outside end. In another embodiment, the post 102 may include a set of three rods or a set of five rods.

Figure 22:
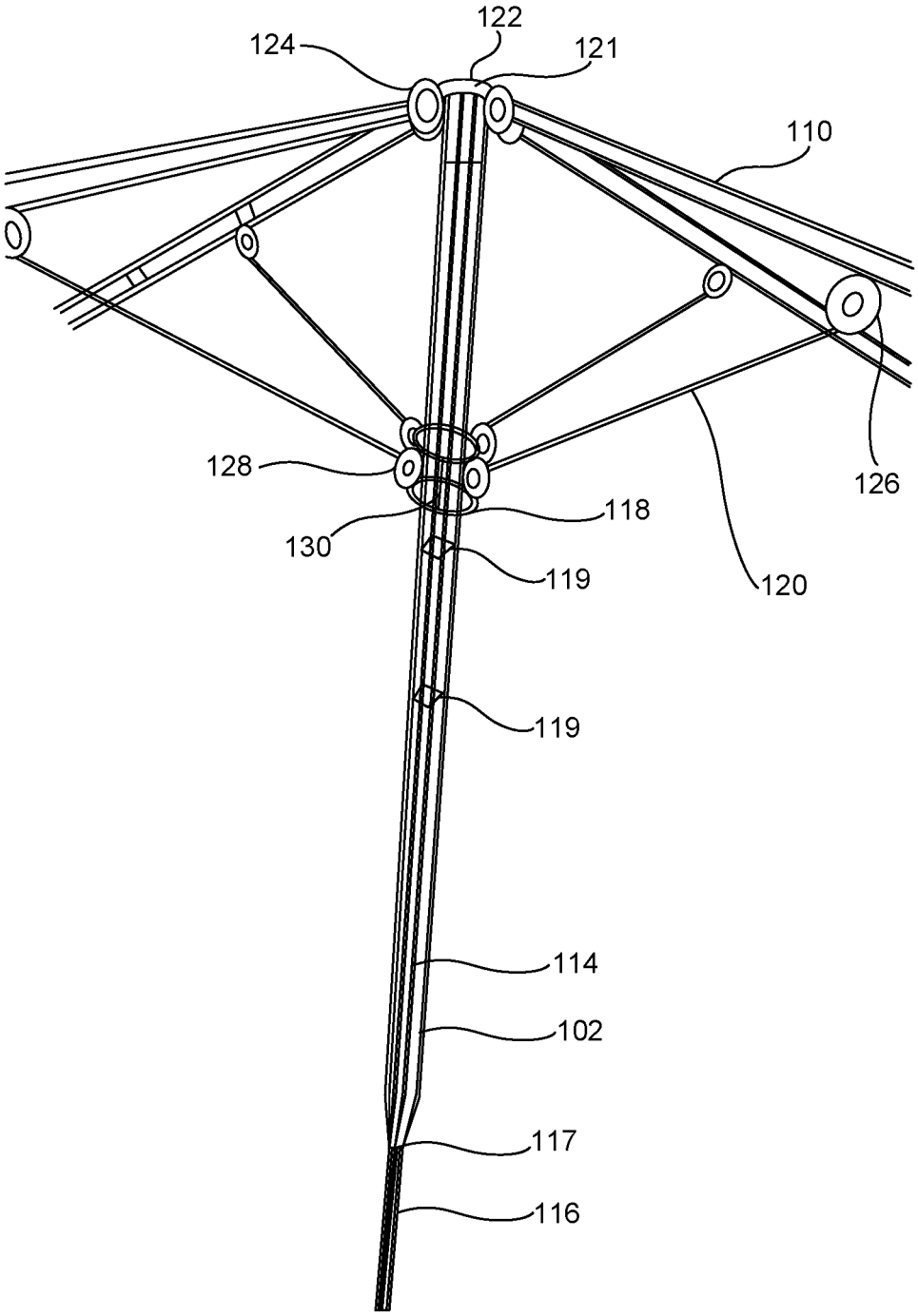
FIG. 22 is a perspective view of the post of the umbrella assembly of FIG. 21 according to an embodiment herein.

FIG. 22 is a perspective view of the post 102 of the umbrella assembly 100 of FIG. 21 according to an embodiment herein. The frame 101 includes the post 102, a top piece, and a post blade 116. The frame 101 includes a plurality of arms 110, a lift ring 118, and a plurality of connectors 120. The frame also includes a first set of rotatable connection members 124, a second set of rotatable connection members 126, and a third set of rotatable connection members 128. In one embodiment, each arm of the plurality of arms 110 is a single half bent wire/rod. In another embodiment, each arm of the plurality of arms 110 is a rigid arm. The plurality of post rods 114 is an assembly of four separate rods. In one embodiment, the plurality of post rods 114 may be an assembly of two half bent rods or two single rods. The post includes two or more separate rods. The assembly of four separate rods converges at the bottom portion of the post 102 forming the post blade 116. The post blade 116 is suitable for inserting into the ground or connecting to the frame extension or base (not shown in FIG. 22). The lift ring 118 raises or lowers the plurality of arms 110. The plurality of connectors 120 connect the plurality of arms 110 to the lift ring 118. Each connector includes two ends, each end rotatably connected to a respective arm. A washer 122 covers top piece 123 (not shown) of the post 102. The top piece 123 includes one side of the first set of rotatable connection members 124. The top piece 123 includes first set of rotatable connection members 124 that connect to the plurality of arms 110. The first set of rotatable connection members 124 allows the plurality of arms 110 to rotate with respect to the top piece 123. The second set of rotatable connection members 126 connects the plurality of arms 110 to the respective plurality of connectors 120. The second set of rotatable connection members 126 allows the plurality of connectors 120 to rotate with respect to the respective of arms 110. The third set of rotatable connection members 128 connects the plurality of connectors 120 to the lift ring 118. The third set of rotatable connection members 128 allows the plurality of connectors 120 to rotate with respect to the lift ring 118. The plurality of connectors is rotatably connected to the lift ring at a location corresponding to the orientation of each respective arm. The first disk includes a central opening fixedly attached to a first side member of the umbrella frame rotatable connection. The first disk further includes one unobstructed surface. The second disk includes a central opening fixedly attached to a second side member of the umbrella frame rotatable connection. The second disk also includes one unobstructed surface. The rotatable connection further includes an axial member having a first end and a second end. The axial member is mounted within the central opening of the first disk and the central opening of the second disk. The unobstructed surface of the first disk is mated to the unobstructed surface of the second disk. The first end and the second end of the axial member includes respective end closers to maintain the axial member within the central openings of the mated first and second disks. The lift ring 118 includes two rings (not shown in FIG. 22) separated by one or more spacers 130 (see FIG. 22). The one or more spacers 130 are small wires that connect an upper ring of the lift ring 118 to a lower ring of the lift ring 118.

In one embodiment, the post 114 may include a plastic rod, a wooden doweling, or a metal or plastic tube. The post includes one or more post rods separated by one or more post rod spacers 117, 119 or 121. In another embodiment, the one or more post rods may be one or more metal wires, one or more metal tubings, one or more dowelings, one or more plastic rods, or one or more plastic tubings. In yet another embodiment, the one or more post rod spacers may be a spherical ball, a plurality of stubs, a transverse cylindrical stub, a longitudinal cylindrical stub, a ring, a "U" bend of the post rod, a connector disk or a convergence of the post rods.

Figure 23A:
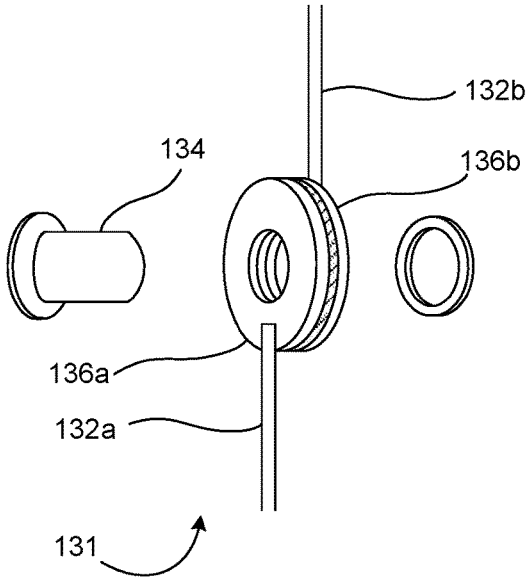
FIG. 23A is a perspective view of a rotatable connection.

FIG. 23A is a perspective view of a rotatable connection member 131 of the first set of rotatable connection members 124 or the second set of rotatable connection members 126 or the third set of rotatable connection members 128 of the post 102 of FIG. 22 according to an embodiment herein. The rotatable connection member 131 includes a first disk 136*a* and a second disk 136*b*. The first disk 136*a* couples a first wire stub 132*a* using a welded joint and the second disk 136*b* couples a second wire stub 132*b* using a welded joint. The first disk and the second disk are connected with each other using a pop rivet 134. In one embodiment, the pop river 134 may be replaced by a nut-bolt combination, or a pin-spring clip combination. The pop rivet 134 acts as an axial member of the rotatable connection member 131.

Figure 23B:
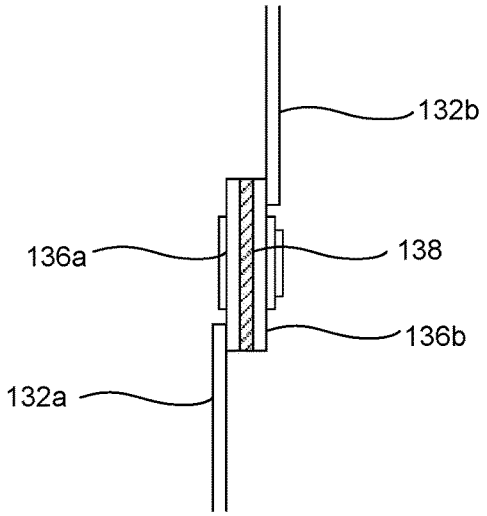
FIG. 23B is a side view of the rotatable connection member of FIG. 23A.

FIG. 23B is a side view of the rotatable connection member 131 of FIG. 23A according to an embodiment herein. The rotatable connection member 131 includes a first disk 136*a*, a second disk 136*b*, the first wire stub 132*a*, the second wire stub 132*b*, and a low friction disk 138. The first wire stub 132*a* connects to the first disk 136*a* at one end and a first member at the other end. The second wire stub 132*b* connects to the second disk 136*b* at one end and a second member at the other end. The first member is rotatable with respect to the second member. The low friction disk 138 is placed in between the first disk 136*a* and the second disk 136*b*. The low friction disk 138 also includes a central opening. The respective adjacent faces of the first disk and second disk are without obstruction. When a user rotates the first member with respect to the second member, the first disk 136*a* rotates with respect to the second disk 136*b*. The low friction disk 138 reduces the friction and enhances the rotation of the first disk 136*a* with respect to the second disk 136*b*. In one embodiment, the material of the rods of the post, arms, and connector is selected from a list of metal wire, metal tubing, wooden doweling, plastic rod, or plastic tubing.

Figure 23C:
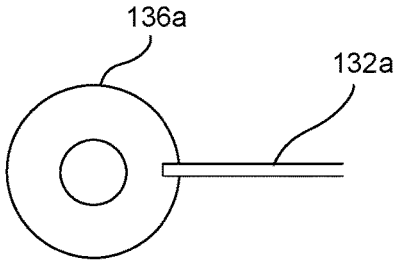
FIGS. 23C and 23D show front view of the rotatable connection fixed to respective wire stubs of different configurations.

FIG. 23C show front view of the rotatable connection member with the first disk 136*a* in front and a wire stub coupled to the first disk 136*a* in the middle portion.

Figure 23D:
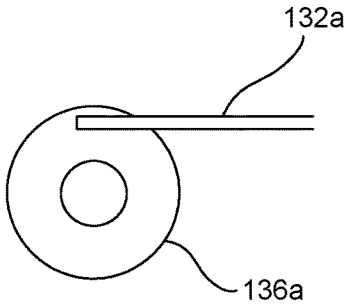

FIG. 23D show front view of the rotatable connection member with the first disk 136*a* in front and a wire stub coupled to the first disk 136*a* in a position offset from middle.

Figure 24A:
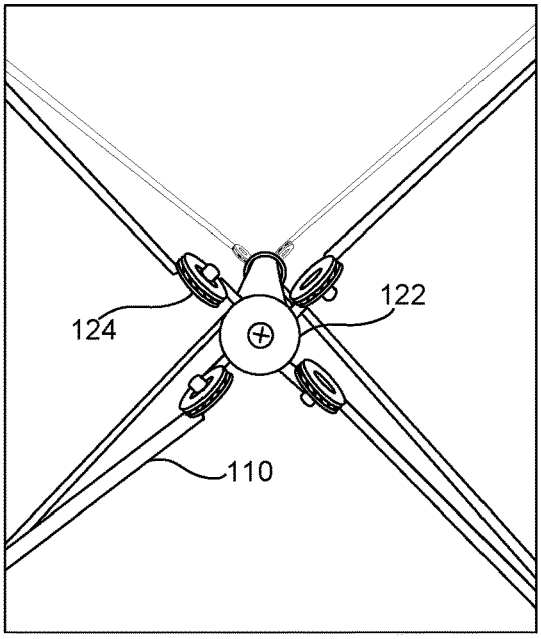
FIG. 24A shows the perspective view of the top of the post of the umbrella frame of FIG. 21 according to an embodiment herein.

FIG. 24A shows the perspective view of the top of the post 102 of the umbrella frame of FIG. 21 according to an embodiment herein. The top of the post 102 includes a cover washer 122. The washer 122 couples the plurality of arms 110 using the first set of rotatable connection members 124. The first set of rotatable connection members 124 make the relative movement in the form of rotation of the plurality of arms 110 with respect to the washer 122.

Figure 24B:
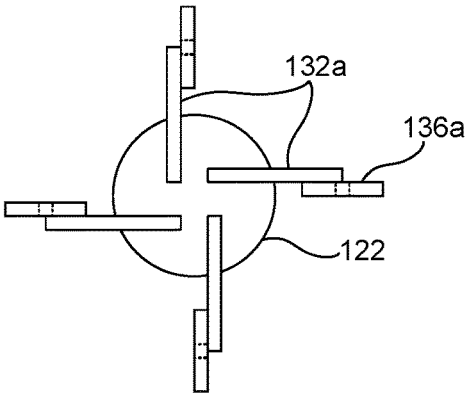
FIG. 24B shows a top view of the post of FIG. 21 according to an embodiment herein.

FIG. 24B shows a top view of the post 102 of FIG. 21 according to an embodiment herein. The top of the post 102 includes the washer 122, the first wire stub 132*a*, and the rotatable connection members. The washer 122 couples the first wire stub 132*a* using a welded joint at one end of the first wire stub 132*a*. The first wire stub 132*a* couples the first disk 136*a* of the rotatable connection member using the welded joint at another end of the first wire stub 132*a*.

Figure 25A:
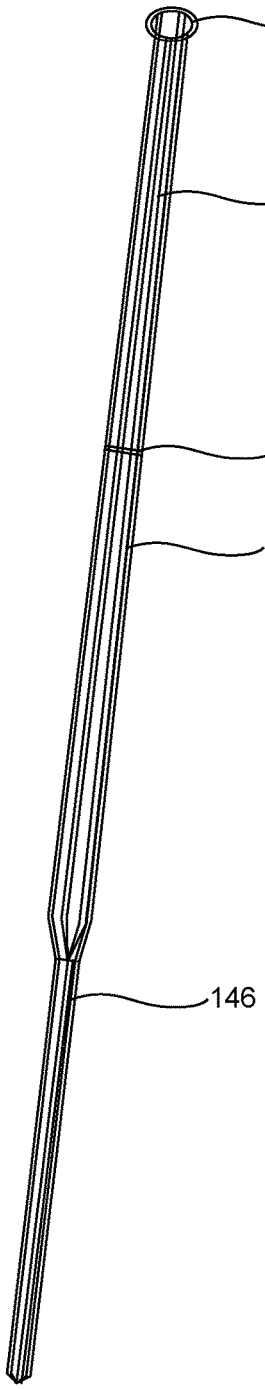
FIG. 25A shows an alternative perspective view of the frame extension of the umbrella assembly of FIG. 21 according to an embodiment herein.

FIG. 25A shows a perspective view of the extension post 104 of the umbrella assembly 100 of FIG. 21 according to an embodiment herein. The extension post 104 includes a top and a bottom portion. The extension post 104 further includes a set of four rods 140, plurality of extension post spacers 104, a first top ring 144, and a second point blade 146. The set of four rods 140 form main part of the extension post 104. The plurality of extension post spacers 104 separates the four rods of the set of rods wires 140 from each other. The first top ring 144 at the top of the extension post 104 acts as a first spacer and receives the first point blade 116 of the post 102. The four rods of the set of rods 140 converge at the bottom portion of the extension post 104 forming the second point blade 146 and spacer.

Figure 25B:
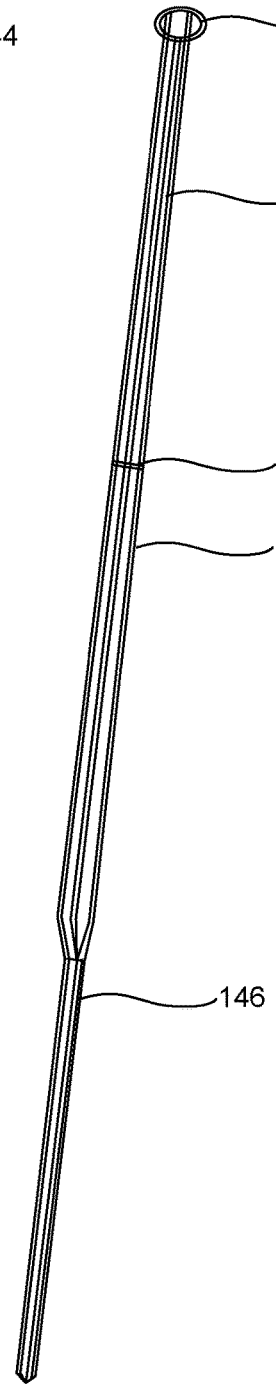
FIGS. 25B and 25C show a perspective view of the extension post 104 of FIG. 25A with three rods and five rods respectively.

FIG. 25B shows a perspective view of the extension post 104 of FIG. 25A with three rods.

Figure 25C:
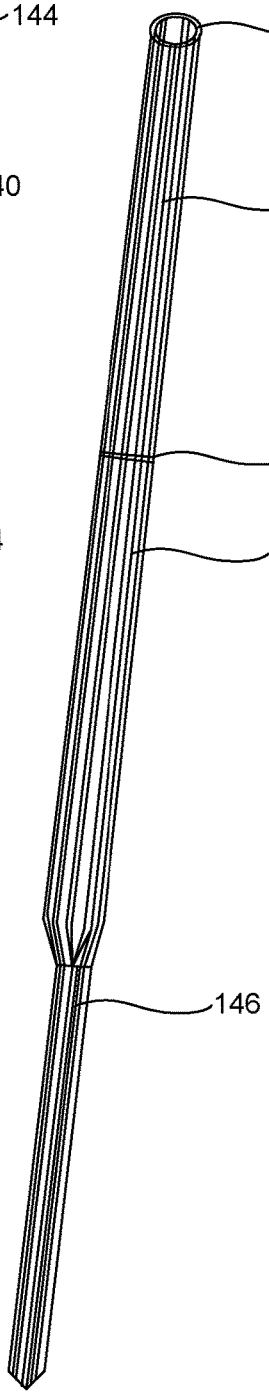

FIG. 25C shows a perspective view of the extension post 104 of FIG. 25A with five rods.

The lower portion of the post rods of the umbrella frame, FIG. 22, or the umbrella extensions, FIG. 25A, 25B, or 25C, converge to form a convergence portion or a blade section. The posts of the blade section are aligned, parallel and in contact to the bottom end of the rods of the frame post or the extension post, respectively. The convergence point operates as the lower spacer of the frame post or the extension post.

The blade facilitates inserting the frame post 102 or the extension 104 into the dirt. In addition the blade of the frame post fits into the receiving section of the umbrella extension or the upright of the base.

Figure 26A:
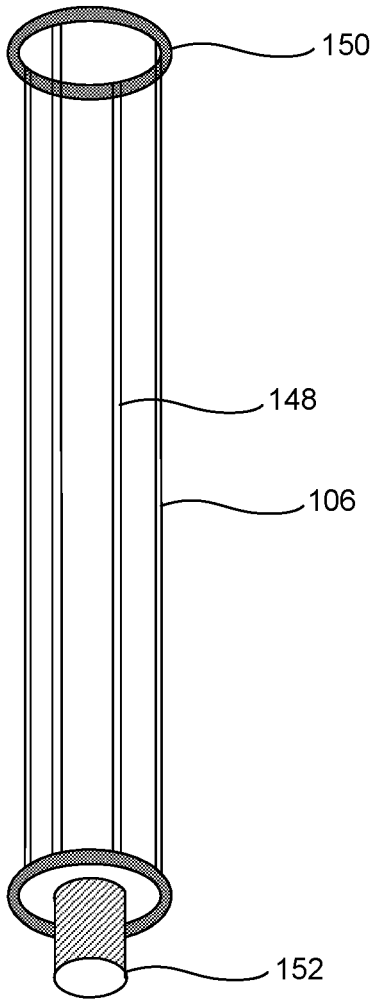
FIG. 26A shows a perspective view of an upright unit of the base of the umbrella assembly of FIG. 21 according to an embodiment herein.

FIG. 26A shows a perspective view of the upright 106 of the base of the umbrella assembly 100 of FIG. 21 according to an embodiment herein. The upright 106 forms a part of the umbrella base. The upright 106 includes an upper upright and a lower upright. The upright 106 further includes a set of upright rods 148, a second top ring 150, and a center bolt 152. In one embodiment, the upper upright is the second top ring 150. The set of upright rods 148 incorporates the second top ring 150 at the top of the upright 106. The second top ring 150 receives the second point blade 146 of the extension post 104 or frame. The set of upright rods 148 further incorporates the center bolt 152 at the bottom of the upright 106. The center bolt 152 includes external threads. In one embodiment, the set of upright rods 148 may include three to five, or six upright rods. The length of the upright 106 is approximately the same as the length of the second point blade 146.

The upper portion of the umbrella extension post 104 or the upright 106 of the base each includes a receiver section. The receiver section includes an exterior ring spacer at the top end of the extension rods and the top end of the base upright rods to maintain the rods in alignment and to operate as the upper spacer. The rods are spaced sufficiently permit the blade of the extension or the frame to fit within the receiver opening of the extension or the base. The rods of the receiver portion are sufficiently close to one another to prevent the blade section form protruding between adjacent rods.

Figure 26B:
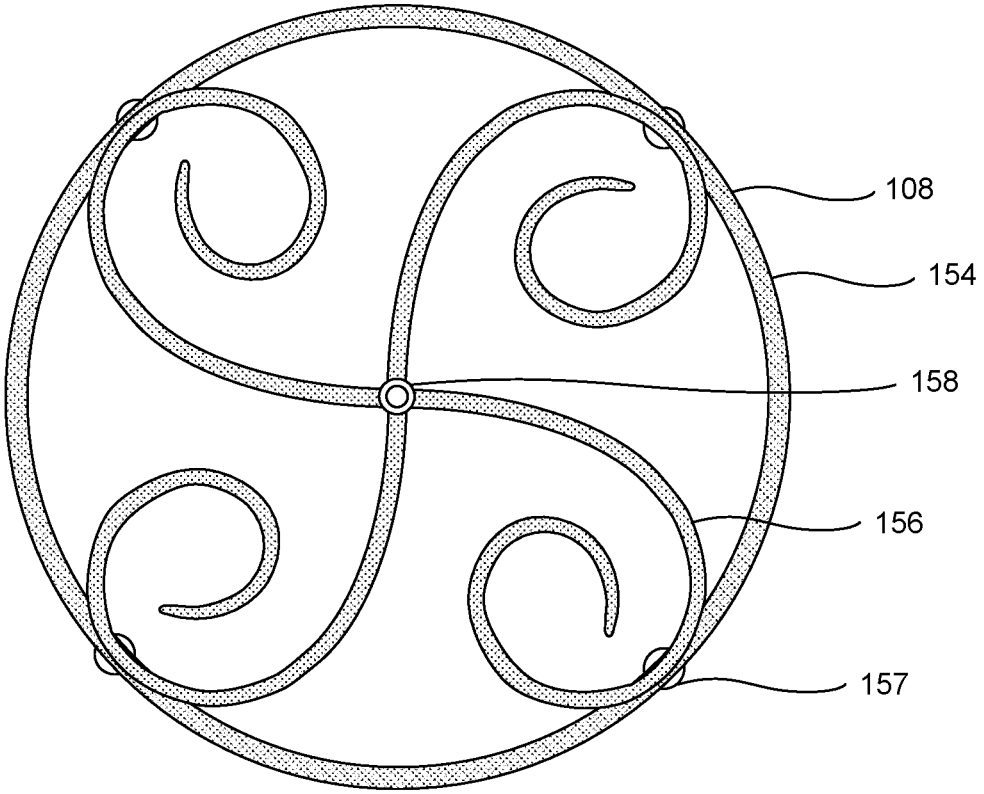
FIG. 26B shows a top view of the platform of the base of the umbrella assembly of FIG. 21 according to an embodiment herein.

FIG. 26B shows a top view of the base platform 108 of the base of umbrella assembly 100 of FIG. 21 according to an embodiment herein. The platform 108 includes a circular outer member 154, one or more radial supports 156, and a center nut 158. The one or more radial supports 156 extend radially from the center towards the periphery of the circular outer member 154. The central receiving member 158 includes internal threads. The center bolt 152 of the upright 106 couples to the central receiving member 158 of the platform 108. In one embodiment, the platform 108 includes two to six radial supports. The platform 108 further includes one or more feet 157 at the bottom portion of the circular outer member 154. In one embodiment, the one or more radial supports are the plurality of spokes.

Figure 27:
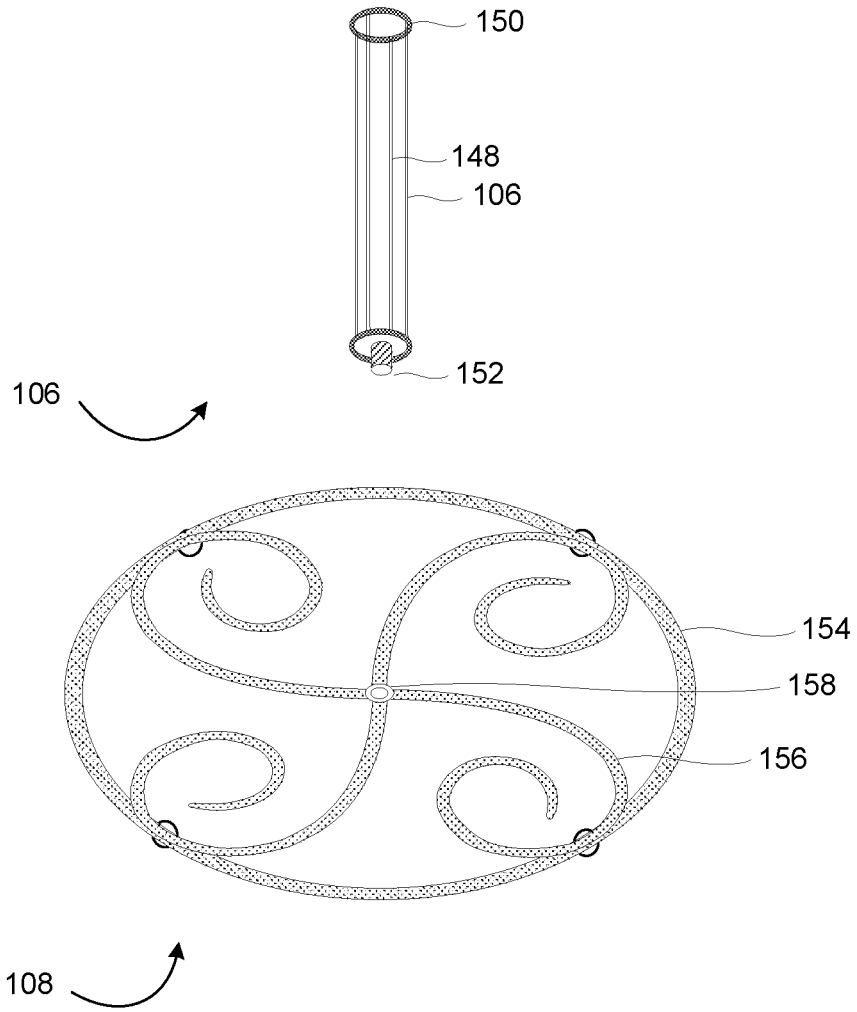
FIG. 27 shows a separate umbrella base of the umbrella assembly including the upright of FIG. 26A and the platform of FIG. 26B according to an embodiment herein.

FIG. 27 shows the umbrella base of the umbrella assembly including the upright 106 of FIG. 26A and the platform 108 of FIG. 26B according to an embodiment herein.

Figure 28A:
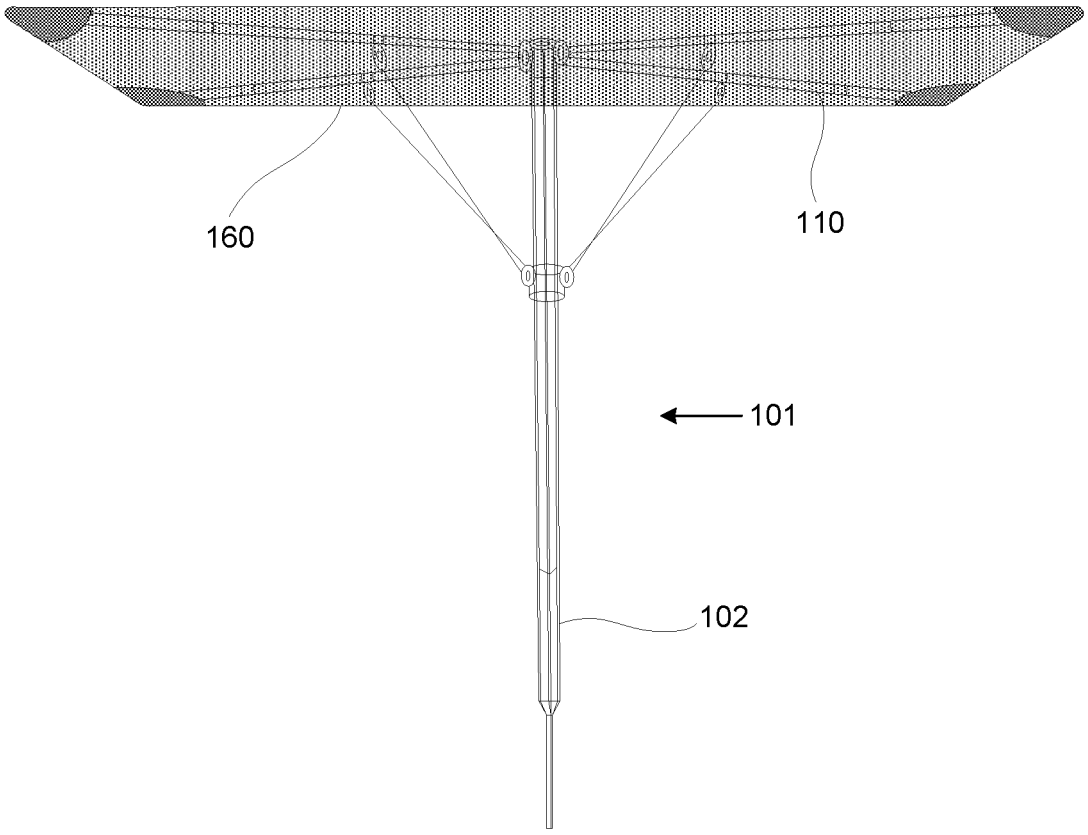
FIGS. 28A and 28B shows a perspective view of the post of the umbrella frame of FIG. 21 with a canopy mounted on the plurality of arms according to an embodiment herein.

FIG. 28A shows a perspective view of the post 102 of the umbrella frame 101 of FIG. 21 with a canopy 160 mounted on the plurality of arms 110, the plurality of arms being perpendicular to the post 102, according to an embodiment herein.

Figure 28B:
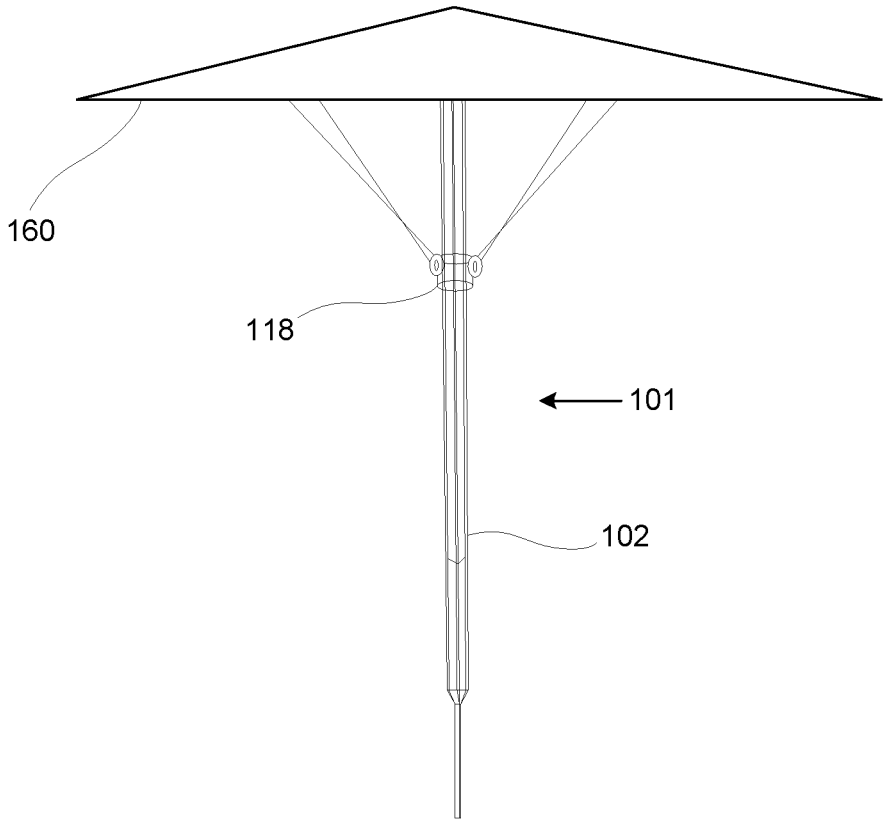

FIG. 28B shows a perspective view of the post 102 of the umbrella frame 101 of FIG. 21 with a canopy 160 mounted on the plurality of arms 110, the plurality of arms being inclined to the post 102, according to an embodiment herein.

Figure 29:
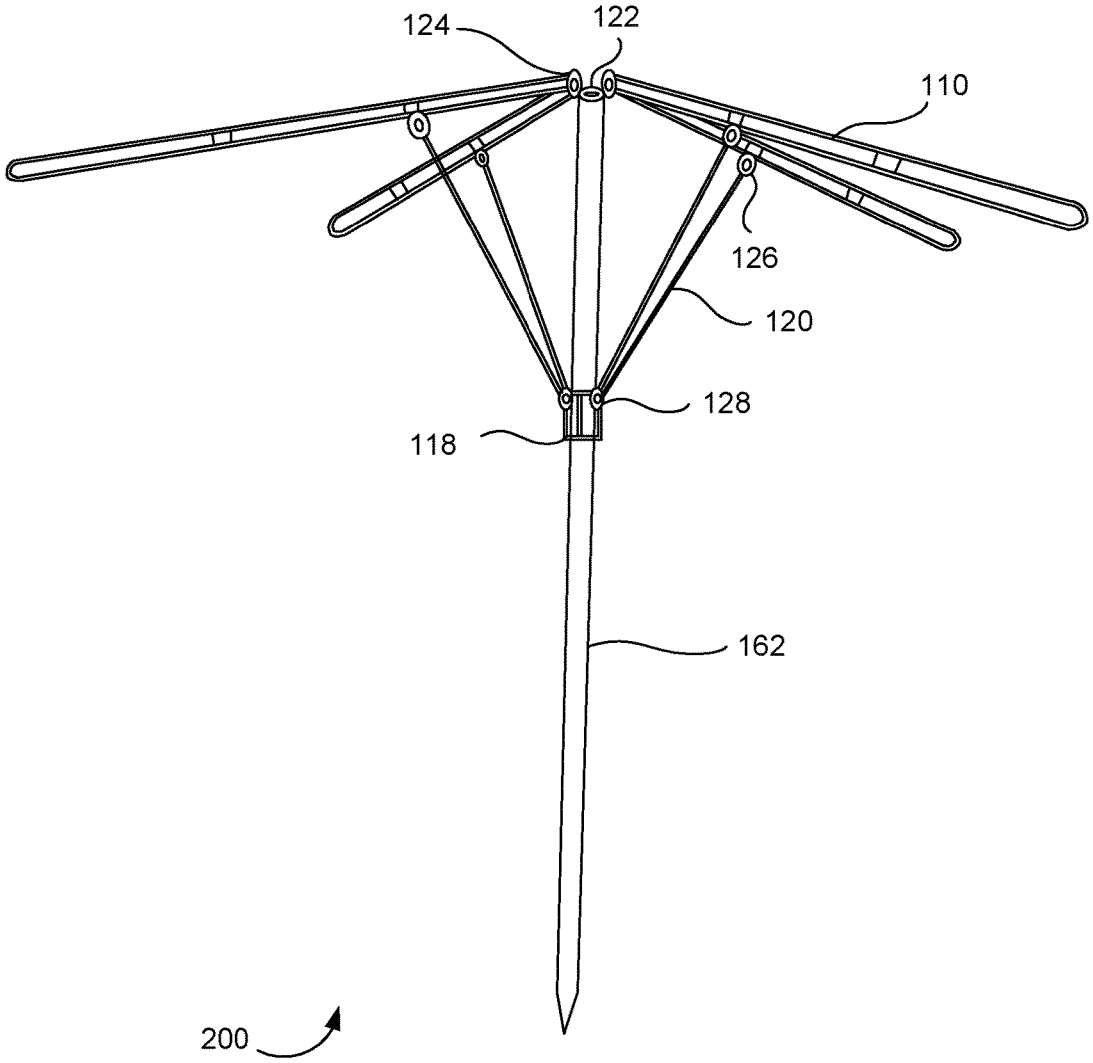
FIG. 29 shows an umbrella according to an embodiment having a solid wooden umbrella frame post according to an embodiment herein.

FIG. 29 shows a wooden umbrella post 162 according to an embodiment herein.

The wooden umbrella frame 200 includes the plurality of arms 110, the lift ring 118, the plurality of connectors 120, the first set of rotatable connection members 124, the second set of rotatable connection members 126, the third set of rotatable connection members 128, and a wooden post 162. The wooden umbrella post 162 is made pointed at the end for inserting into the ground. In another embodiment, the wooden post 162 may be a hollow metal tube, a solid metal tube or a solid or tubular plastic.

The low friction disk 138 of FIG. 23B reduces the friction that may show up when the first disk 136*a* is rotated with respect to the second 136*b*. The point blade 114 of FIG. 22 and the second point blade 146 of FIGS. 25A, 25B and 25C make it convenient for the post and the wire extension to be inserted into the dirt. The post being a set of multiple wires rather than a single wire, provide more strength to the umbrella frame 101 and to the extension 104. The spacers provide significant resistance to bending. The wires (rods) instead of single thick wire, as the post provides increased strength over a single wire and reduces the overall weight of the umbrella frame. The lock pin 103 is inserted below the lift ring 124 and above the spacer 119 to lock the arms of the umbrella frame at a desired open position.

Figure 30:
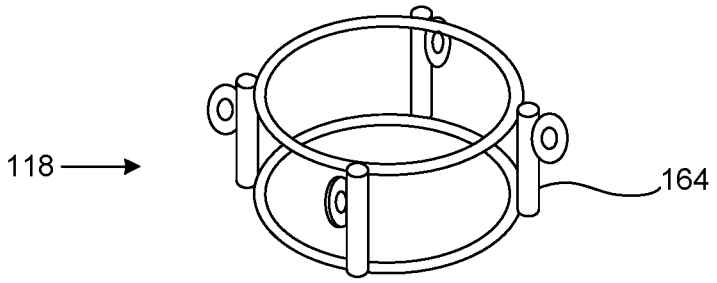
FIG. 30 illustrates a perspective view of the lift ring with a plurality of vertical ring spacers according to an embodiment herein.

FIG. 30 illustrates a perspective view of the lift ring 118 with a plurality of vertical ring spacers 164 according to an embodiment herein. The lift ring 118 includes an upper ring and a lower ring. The upper ring and the lower ring are coupled using the plurality of vertical ring spacers 164. The plurality of vertical ring spacers couple a plurality of rotatable connection members.

Figure 31A:
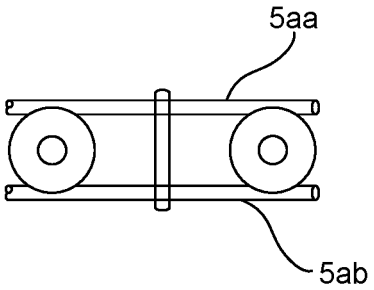
FIGS. 31A and 31B illustrate a plurality of rod connector and variety of spacers including end washer, center parallel and perpendicular spacer elements according to an embodiment herein.
Figure 31B:
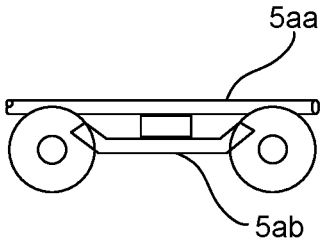

FIGS. 31A and 31B illustrate a plurality of rod connector and variety of spacers including end washer, center parallel and perpendicular spacer elements according to an embodiment herein.

Figure 32A:
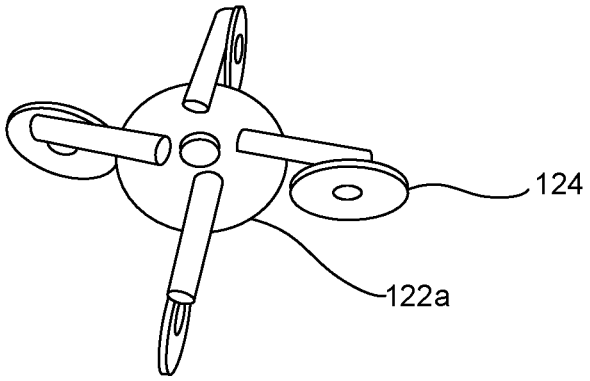
FIG. 32A illustrates the top piece which provides the post end of the rotatable connection between the post and plurality of arms according to an embodiment herein.

FIG. 32A illustrates the top of the frame post 102 including a top piece 122*a* which provides the post end of the rotatable connection 124 between the post 102 and plurality of arms according to an embodiment herein. The top piece 122 includes a disk and a plurality of stubs which are radially attached to the disk and oriented to the positions of the various arms. The outside end of each stub is attached to a first disk with central opening, act of the first disks of the top piece 122 attaches to a second disk with central opening of each arm with an axial having one flared end and which has a secured end attached to the other end.

Figure 32B:
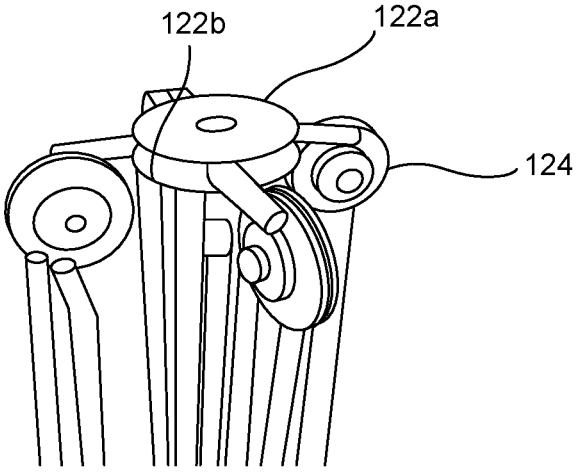
FIG. 32B includes the top piece including a second disk according to an embodiment herein.

In an alternative embodiment as shown in FIG. 32B the top piece as above includes a second disk 122*b* to cover stubs. This embodiment permits attachment to the top of the post 102 at any orientation.

Figure 32C:
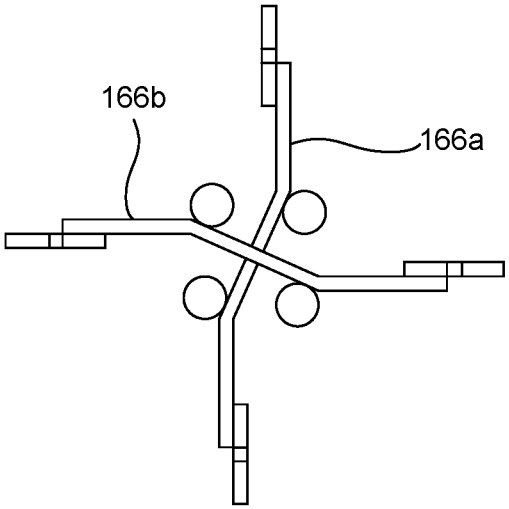
FIGS. 32C and 32D show two top rods fitted in between adjacent post rods of the post according to an embodiment herein.
Figure 32D:
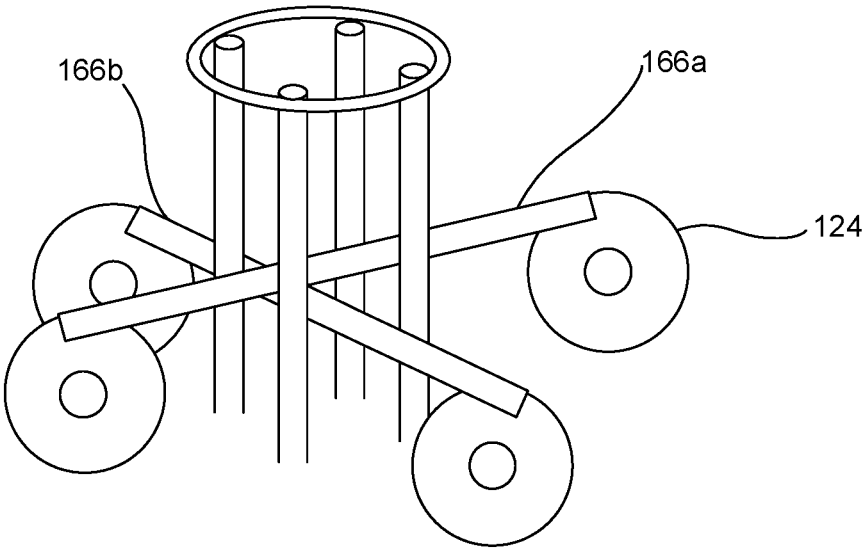

In an alternative embodiment the post end of the post 102 to arm rotatable connection 124 includes two top rods (166*a*, 166*b*), as shown in FIGS. 32C and 32D, which fits between and between adjacent posts proximate the top of the post. The top rods extend beyond the post rods and are attached to one post rod on either side of the post. The second top rod fits between the remaining two rods. The second top rod extends beyond the post rods and is attached to one post rod on either side of the post. The second top rods connected to the first top rod at the point the cross in the center opening of the post. Each of the outer ends of the top rods is attached to a first disk with a central opening for attachment to a second disk with central opening of each arm. The cross arms can be mounted to the post at a position downward from the top of the post 102. The top of the post 102 can include a receiver section. The receive section can accept an ornamental feature such as a post and flag, a finial or even a tiny umbrella frame and canopy.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An umbrella frame, comprising:

a center post comprising a plurality of parallel post rods spaced apart from one another by a plurality of post rod spacers distributed along the length of the center post;

a plurality of arms extending outwardly from a top end of the center post, each arm being connected to the center post by a first rotatable connection member;

a lift ring mounted circumferentially to the center post and being moveable up and down the center post; and a plurality of connector arms, each connector arm having a first end connected to the lift ring and a second end connected to a fixed intermediate location along one of the arms, each connector arm being connected to the lift ring by a second rotatable connection member, and each connector arm being connected to the fixed intermediate location along one of the arms by a third rotatable connection member;

at least one of the first, second or third rotatable connection members comprise:

a first disk with a central opening, a second disk with a central opening, and an axial member passing through the central openings of the first and second disks permitting the first and second disks to rotate with respect to one another.

2. The umbrella frame of claim 1, wherein at least one of the first, second and third rotatable connection members further comprises a low friction disk with a central opening, the low friction disk being positioned between the first and second disks with the axial member passing therethrough to reduce friction caused by rotation of the first disk with respect to the second disk.

3. The umbrella frame of claim 1, wherein the axial member is a pop rivet.

4. The umbrella frame of claim 1, further comprising: a base for supporting the center post.

5. The umbrella frame of claim 1, further comprising: an extension member for supporting the center post.

6. The umbrella frame of claim 5, further comprising: a base for supporting the extension member.

7. The umbrella frame of claim 1, wherein each of the plurality of arms comprise a plurality of parallel arm rods spaced apart from one another by a plurality of arm spacers distributed along the length of the arm.

8. The umbrella frame of claim 1, wherein each of the plurality of connector arms comprise a plurality of parallel connector arms spaced apart from one another by a plurality of connector arm spacers distributed along the length of the connector arm.

9. The umbrella frame of claim 1, wherein the lift ring comprises an upper lift ring and a lower lift ring spaced apart by a plurality of vertical ring spacers.

10. The umbrella frame of claim 1, further comprising: a canopy mounted onto the plurality of arms.

11. An umbrella frame, comprising:

a center post;

a plurality of arms extending outwardly from a top end of the center post, each arm being connected to the center post by a first rotatable connection member, wherein each of the plurality of arms comprise a plurality of parallel arm rods spaced apart from one another by a plurality of connector arm spacers distributed along the length of the arm;

a lift ring mounted circumferentially to the center post and being moveable up and down the center post; and a plurality of connector arms, each connector arm having a first end connected to the lift ring and a second end connected to a fixed intermediate location along one of the arms, each connector arm being connected to the lift ring by a second rotatable connection member, and each connector arm being connected to the fixed intermediate location along one of the arms by a third rotatable connection member;

at least one of the first, second or third rotatable connection members comprise:

a first disk with a central opening, a second disk with a central opening, and an axial member passing through the central openings of the first and second disks permitting the first and second disks to rotate with respect to one another.

12. The umbrella frame of claim 11, wherein at least one of the first, second and third rotatable connection members further comprises a low friction disk with a central opening, the low friction disk being positioned between the first and second disks with the axial member passing therethrough to reduce friction caused by rotation of the first disk with respect to the second disk.

13. The umbrella frame of claim 11, further comprising: an extension member for supporting the center post.

14. The umbrella frame of claim 13, further comprising: a base supporting the extension member.

15. The umbrella frame of claim 11, further comprising: a base for supporting the center post.

16. The umbrella frame of claim 11, wherein the lift ring comprises an upper lift ring and a lower lift ring spaced apart by a plurality of vertical ring spacers.

17. The umbrella frame of claim 11, further comprising: a canopy mounted onto the plurality of arms.

18. An umbrella frame, comprising:

a center post comprising a plurality of parallel post rods spaced apart from one another by a plurality of post rod spacers distributed along the length of the center post;

a plurality of arms extending outwardly from a top end of the center post, each arm being connected to the center post by a first rotatable connection member, wherein each of the plurality of arms comprise a plurality of parallel arm rods spaced apart from one another by a plurality of connector arm spacers distributed along the length of the arm;

a lift ring mounted circumferentially to the center post and being moveable up and down the center post; and a plurality of connector arms, each connector arm having a first end connected to the lift ring and a second end connected to a fixed intermediate location along one of the arms, each connector arm being connected to the lift ring by a second rotatable connection member, and each connector arm being connected to the fixed intermediate location along one of the arms by a third rotatable connection member;

wherein at least one of the first, second or third rotatable connection members comprise:

a first disk with a central opening, a second disk with a central opening, and an axial member passing through the central openings of the first and second disks permitting the first and second disks to rotate with respect to one another.

19. The umbrella frame of claim 18, wherein at least one of the first, second and third rotatable connection members further comprises a low friction disk with a central opening, the low friction disk being positioned between the first and second disks with the axial member passing therethrough to reduce friction caused by rotation of the first disk with respect to the second disk.

* * * * *